US012747867B2

(12) United States Patent
Park

(10) Patent No.: US 12,747,867 B2
(45) Date of Patent: Sep. 29, 2026

(54) COOKING APPARATUS AND METHOD OF CONTROLLING THE SAME

(71) Applicant: Samsung Electronics Co., Ltd., Suwon-si (KR)

(72) Inventor: Dahwe Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 751 days.

(21) Appl. No.: 17/662,049

(22) Filed: May 4, 2022

(65) Prior Publication Data

US 2022/0364738 A1 Nov. 17, 2022

Related U.S. Application Data

(63) Continuation of application No. PCT/KR2022/006235, filed on May 2, 2022.

(30) Foreign Application Priority Data

May 11, 2021 (KR) ..... 10-2021-0060928
Apr. 29, 2022 (KR) ..... 10-2022-0053610

(51) Int. Cl.
*F24C 15/20* (2006.01)

(52) U.S. Cl.
CPC ..... *F24C 15/2042* (2013.01); *F24C 15/2085* (2013.01)

(58) Field of Classification Search
CPC .. F24C 15/2042; F24C 15/2085; F24C 15/20; B01D 5/00; B01D 53/00; F24F 7/06; F24F 11/77

(Continued)

(56) References Cited

U.S. PATENT DOCUMENTS 5,548,104 A * 8/1996 Ko ..... H05B 6/68 219/685
6,114,659 A * 9/2000 Finck ..... A47F 3/0447 219/400

(Continued)

FOREIGN PATENT DOCUMENTS

CN 106705158 A * 5/2017 ..... F24C 15/2042
CN 106765409 A * 5/2017 ..... F24C 15/2028

(Continued)

OTHER PUBLICATIONS

German to English machine translation for DE_102016207087_A1 (Year: 2006).*

(Continued)

*Primary Examiner* — Michael G Hoang
*Assistant Examiner* — Elizabeth Ann Laughlin

(57) ABSTRACT

Provided is a cooking apparatus comprising: a heating device including a plurality of burners; an intake duct provided on a first side of the heating device and configured to move upward or downward, and including a suction port configured to suction air; at least one exhaust duct provided on a second side of the heating device opposite the intake duct and configured to move upward or downward, and including a discharge port configured to discharge air; a control panel configured to obtaining user input; and a processor configured to adjust a position for each of the intake duct and the at least one exhaust duct based on at least one of identification of a container placed on at least one burner of the heating device or selection of a burner by the user input.

13 Claims, 16 Drawing Sheets

(58) Field of Classification Search
USPC ..... 126/299 R
See application file for complete search history.

(56) References Cited

U.S. PATENT DOCUMENTS

| | | | | |
|---|---|---|---|---|
| 6,895,955 | B2 | 5/2005 | Galassi | |
| 8,312,873 | B2 | 11/2012 | Gagas et al. | |
| 9,772,117 | B2 | 9/2017 | Feisthammel et al. | |
| 9,874,356 | B2 | 1/2018 | Jeong et al. | |
| 2003/0162491 | A1 | 8/2003 | Kanaya | |
| 2008/0067167 | A1* | 3/2008 | Sung | F24C 15/101 219/448.11 |
| 2010/0065038 | A1 | 3/2010 | Davies | |
| 2013/0320000 | A1* | 12/2013 | Shan | H05B 6/062 219/620 |
| 2014/0027439 | A1* | 1/2014 | Bach | A21B 1/22 219/412 |
| 2014/0182575 | A1 | 7/2014 | Burdett et al. | |
| 2021/0041112 | A1* | 2/2021 | Pi | F24C 15/2035 |
| 2021/0123602 | A1* | 4/2021 | Heo | B08B 1/32 |

FOREIGN PATENT DOCUMENTS

| | | | | | |
|---|---|---|---|---|---|
| CN | 108072085 | A | | 5/2018 | |
| DE | 10216012 | A1 | * | 10/2003 | F24C 15/2042 |
| DE | 102016207087 | A1 | * | 10/2017 | F24C 15/2042 |
| DE | 102018200764 | A1 | | 7/2019 | |
| DE | 102020114719 | A1 | | 4/2021 | |
| EP | 2489943 | A1 | * | 8/2012 | F28D 21/0003 |
| JP | H-05126375 | A | | 5/1993 | |
| JP | H09264580 | A | | 10/1997 | |
| JP | 2000166770 | A | | 6/2000 | |
| JP | 3893596 | B2 | | 3/2007 | |
| JP | 4495433 | B2 | | 7/2010 | |
| JP | 2011-106729 | A | | 6/2011 | |
| JP | 6091139 | B2 | | 3/2017 | |
| JP | 2019-007715 | A | | 1/2019 | |
| KR | 20060067766 | A | * | 6/2006 | F24C 15/2021 |
| KR | 10-2008-0025603 | A | | 3/2008 | |
| KR | 10-2017-0008067 | A | | 1/2017 | |
| KR | 20180071686 | A | | 6/2018 | |
| KR | 10-2018-0079867 | A | | 7/2018 | |
| KR | 101934457 | B1 | | 1/2019 | |
| KR | 20190081498 | A | | 7/2019 | |
| KR | 10-2011425 | B1 | | 8/2019 | |
| KR | 10-2020-0116647 | A | | 10/2020 | |
| KR | 10-2175640 | B1 | | 11/2020 | |
| KR | 10-2020-0134664 | A | | 12/2020 | |
| KR | 10-2021-0050428 | A | | 5/2021 | |
| KR | 10-2021-0050430 | A | | 5/2021 | |
| KR | 20210050429 | A | | 5/2021 | |

OTHER PUBLICATIONS

Korean to English translation for KR_20060067766_A (Year: 2017).*
Chinese to English machine translation of CN_106765409_A.*
Merriam-Webster, Elevator, 1 page, https://www.merriam-webster.com/dictionary/elevator.*
Fuji, Traction_Elevator_VS_Hydraulic_Elevators_Making_The_Right_Choice, 8 pages, https://www.fujilift-china.com/blog/traction-elevator-vs-hydraulic/.*
Research Gate, Evaporation Reduction by Manipulation of Surface Area to vol. Rations: Overview Analysis and Effectiveness, 8 pages, https://www.researchgate.net/publication/249012432_Evaporation_reduction_by_manipulation_of_surface_area_to_volume_ratios_overview_analysis_and_effectiveness (Year: 2009).*
Chinese to English machine translation of CN106705158A.*
German to English machine translation of DE_10216012_A1.*
Supplementary European Search Report dated Jun. 13, 2024, in connection with European Patent Application No. 22807686.5, 9 pages.
International Search Report of the International Searching Authority dated Jun. 30, 2022, in connection with International Application No. PCT/KR2022/003479, 7 pages.
International Search Report of the International Searching Authority dated Aug. 16, 2022, in connection with International Application No. PCT/KR2022/006235, 7 pages.
Notice of Allowance dated Mar. 18, 2025, in connection with European Patent Application No. 22807686.5, 73 pages.
Office Action issued Mar. 16, 2026, in connection with Chinese Patent Application No. 202280015830.4, 20 pages.
Office Action issued Jun. 22, 2026, in connection with Korean Patent Application No. 10-2022-0053610, 11 pages.

* cited by examiner

COOKING APPARATUS AND METHOD OF CONTROLLING THE SAME

CROSS-REFERENCE TO RELATED APPLICATION

This application is a bypass continuation of International Application No. PCT/KR2022/006235, filed May 2, 2022, which is based on and claims priority under 35 U.S.C. § 119 to Korean Patent Application No. 10-2021-0060928, filed May 11, 2021, and Korean Patent Application No. 10-2022-0053610, filed Apr. 29, 2022, in the Korean Intellectual Property Office, the disclosures of which are incorporated herein by reference in their entirety.

BACKGROUND

1. Field

The disclosure relates to a cooking apparatus including a ventilation device capable of collecting oil mist generated during a cooking process, and a method of controlling the same.

2. Description of the Related Art

In a cooking process using a heating device, such as a gas stove or induction stove, contaminated air containing a large amount of oil mist may be generated.

Conventionally, contaminated air generated due to an operation of a heating device is suctioned using a hood located above the heating device. However, in the conventional technology, the suction efficiency and filtering efficiency of the contaminated air are low, and the contaminated air spread may exert an influence on the user.

In addition, as the oil mist contained in the contaminated air contaminates a blower disposed inside the conventional hood, the blower may malfunction or emit a bad odor.

SUMMARY

Therefore, it is an aspect of the present disclosure to provide a cooking apparatus capable of effectively preventing contaminated air generated during a cooking process from spreading, and a method of controlling the same.

Additional aspects of the disclosure will be set forth in part in the description which follows and, in part, will be obvious from the description, or may be learned by practice of the disclosure.

In accordance with one aspect of the present disclosure, there is provided a cooking apparatus comprising: a heating device including a plurality of burners; an intake duct provided on a first side of the heating device and configured to move upward or downward, and including a suction port configured to suction air; at least one exhaust duct provided on a second side of the heating device opposite the intake duct and configured to move upward or downward, and including a discharge port configured to discharge air; a control panel configured to obtaining user input; and a processor configured to adjust a position for each of the intake duct and the at least one exhaust duct based on at least one of identification of a container placed on at least one burner of the heating device or selection of a burner by the user input.

The processor may be configured to adjust an elevation height for each of the intake duct and the at least one exhaust duct based on a size of the container.

The elevation height for each of the intake duct and the at least one exhaust duct may be adjusted such that the suction port and the discharge port are located at positions higher than a position of the container.

The processor may be configured to adjust an elevation height for each of the intake duct and the at least one exhaust duct based on an operation mode selected through the control panel.

The processor may be configured to rotate the at least one exhaust duct such that the discharge port is directed to face the container or the burner selected by the user input.

The cooking apparatus may include at least one blower configured to flow air such that the air sucked through the intake duct is discharged through the at least one exhaust duct, wherein the processor may be configured to adjust a rotation speed of the at least one blower based on at least one of a position of the container, a size of the container or a position of the burner selected by the user input.

The cooking apparatus may include: a first elevation device configured to raise or lower the intake duct; and a second elevation device configured to raise or lower the at least one exhaust duct, wherein the processor may be configured to control the first elevation device and the second elevation device.

The at least one exhaust duct may include: a first exhaust duct including a first discharge port; and a second exhaust duct including a second discharge port and provided to be spaced apart from the first exhaust duct on the second side of the heating device.

The processor may be configured, based on a size of the container or an operation mode of the cooking apparatus, to adjust a first elevation height of the intake duct, and adjust a second elevation height of the first exhaust duct and a third elevation height of the second exhaust duct to be same as or different from each other.

The processor may be configured to adjust a first rotation angle of the first exhaust duct and a second rotation angle of the second exhaust duct such that the first discharge port and the second discharge port are directed to face the container or the burner selected by the user input.

The cooking apparatus may include: a first blower configured to flow the air sucked through the intake duct the first exhaust duct; and a second blower configured to flow the air sucked through the intake duct to the second exhaust duct, wherein the processor is configured to adjust a first rotation speed of the first blower and a second rotation speed of the second blower to be same as or different from each other based on a position of the container or a position of the burner selected by the user input.

In accordance with another aspect of the present disclosure, there is provided a method of controlling a cooking apparatus including a heating device, the method comprising: identifying at least one of a burner selected by a user input from among a plurality of burners of the heating device or a container placed on at least one burner of the heating device; adjusting, based on the identifying at least one of the container or selection of the burner, a position for each of an intake duct located on a first side of the heating device and at least one exhaust duct located on a second side of the heating device opposite the first side; and operating at least one blower provided to discharge air sucked through the intake duct through the at least one exhaust duct.

The adjusting of the position may include adjusting an elevation height for each of the intake duct and the at least one exhaust duct based on an operation mode of the cooking apparatus.

The adjusting of the position may include adjusting an elevation height for each of the intake duct and the at least one exhaust duct based on a size of the container.

The adjusting of the position may include adjusting an elevation height for each of the intake duct and the at least one exhaust duct such that a suction port provided in the intake duct and a discharge port provided in the at least one exhaust duct are located at positions higher than a position of the container.

The adjusting of the position may include rotating the at least one exhaust duct such that the discharge port provided in the at least one exhaust duct is directed to face the container or the burner selected by the user input.

The operating the at least one blower may include adjusting a rotation speed of the blower based on at least one of a position of the container and a size of the container or a position of the burner selected by the user input.

The at least one exhaust duct may include: a first exhaust duct including a first discharge port; and a second exhaust duct including a second discharge port and provided to be spaced apart from the first exhaust duct on the second side of the heating device, wherein the adjusting of the position may include adjusting a first elevation height of the intake duct, and adjusting a second elevation height of the first exhaust duct and a third elevation height of the second exhaust duct to be same as or different from each other, based on a size of the container or an operation mode of the cooking apparatus.

The adjusting of the position may include adjusting a first rotation angle of the first exhaust duct and a second rotation angle of the second exhaust duct such that the first discharge port and the second discharge port are directed to face the container or the burner selected by the user input.

The blower may include: a first blower configured to flow the air sucked through the intake duct to the first exhaust duct; and a second blower configured to flow the air sucked through the intake duct to the second exhaust duct, wherein the operating the at least one blower may include adjusting a first rotation speed of the first blower and a second rotation speed of the second blower to be same as or different from each other based on a position of the container or a position of the burner selected by the user input.

Before undertaking the detailed description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
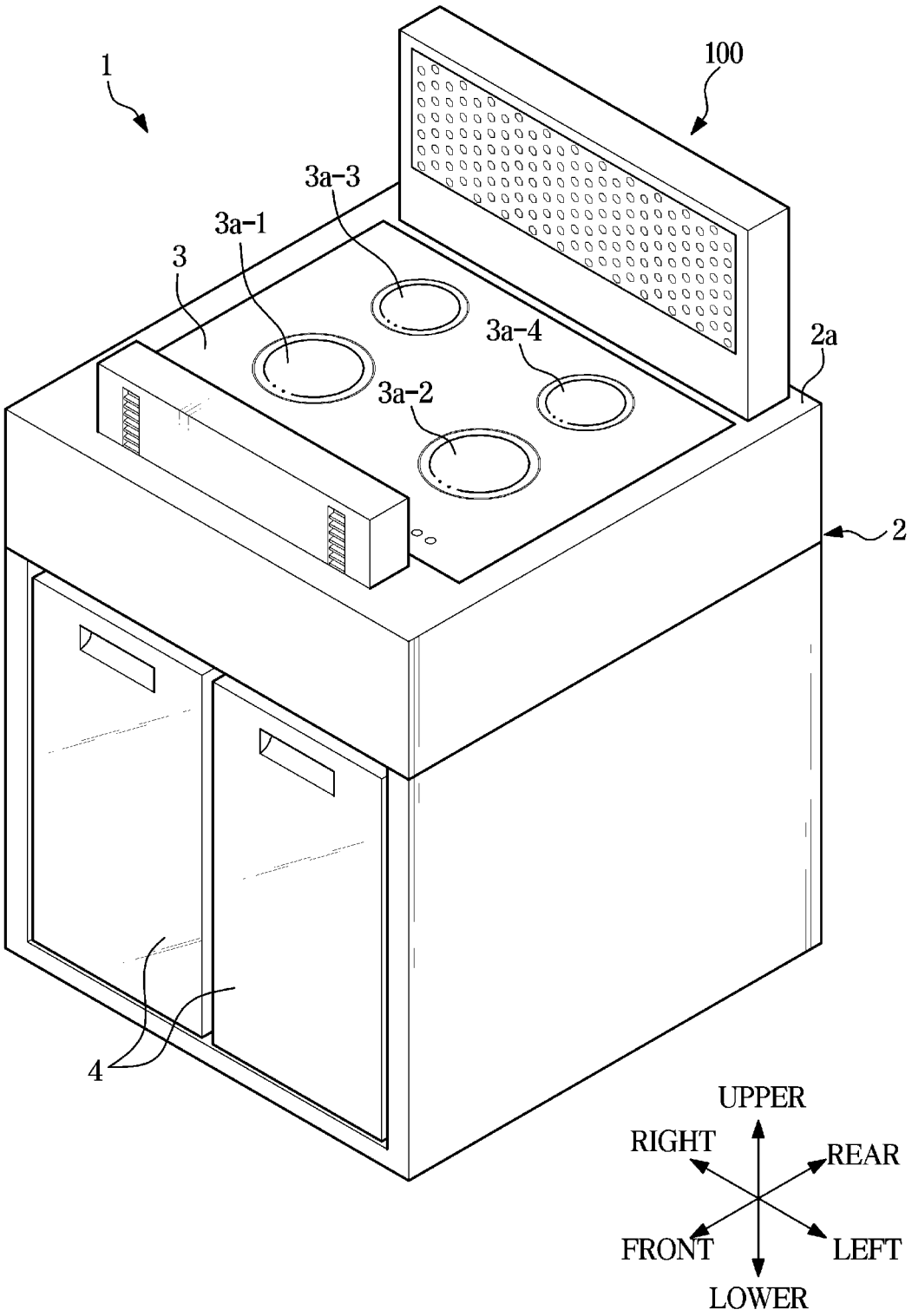
FIG. 1 illustrates an example cooking apparatus according to various embodiments of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Like reference numerals refer to like elements throughout the specification. The specification does not describe all elements of embodiments, and common knowledge in the technical field to which the disclosure pertains or the same descriptions of the embodiments will be omitted. The term "unit," "module," "member," or "block" used herein may be implemented using hardware or software. According to the embodiments, one component may be implemented as a plurality of "units," "modules," "members," or "blocks," or one "unit," "module," "member," or "block" may include a plurality of components.

Throughout the specification, when a part is referred to as being "connected" to another part, it includes being "directly connected" and "indirectly connected through another component," and the term "indirectly connected" includes "connected through a wireless communication network" or "electrically connected through an electrical line."

In addition, the terms used in the specification are used to describe the embodiments and are not used to restrict or limit the disclosure. A single form of expression is meant to include multiple elements unless otherwise stated. It will be further understood that the term "comprise," "include," or "have," when used herein, is used to describe the presence of stated features, numbers, steps, operations, elements, components, and/or combinations thereof but is not used to exclude other features or elements being further included.

In addition, in the specification, terms including ordinal numbers such as "first" and "second" are used to distinguish a plurality of components, and the used ordinal numbers do not indicate the arrangement order, manufacturing order, or importance between the components. A term "and/or" includes a combination of a plurality of associated disclosed items or any item of the plurality of associated disclosed items. Hereinafter, embodiments of the disclosure will be described in detail.

The terms "front", "rear", "upper", "lower", "top", and "bottom" as herein used are defined with respect to the drawings, but the terms may not restrict the shape and position of the respective components.

Hereinafter, various embodiments of the disclosure are described in detail.

FIG. 1 illustrates an example cooking apparatus according to various embodiments of the present disclosure.

Referring to FIG. 1, a cooking apparatus 1 may include a main body 2, a heating device 3, and a ventilation device 100 (or a "hood"). Hereinafter, the structure of the cooking apparatus 1 will be described. The following description may be applied not only to the ventilation device 100 included in the cooking apparatus 1 but also to the ventilation device 100 provided alone.

In the following description, the ventilation device 100 is illustrated as suctioning contaminated air generated during a cooking process using the heating device 3 and discharging purified air. However, the disclosure is not limited thereto, and the ventilation device 100 may suction contaminated air generated by other contamination sources rather than the heating device 3, and discharge purified air.

The main body 2 may form the external structure of the cooking apparatus 1. The main body 2 may be disposed on the floor of the kitchen. The main body 2 may have various shapes (e.g., a box shape). A storage space may be formed in a lower portion of the main body 2, and a storage cabinet door 4 provided to open and close the storage space may be disposed on the front side of the main body 2. However, the disclosure is not limited thereto. The storage cabinet door 4 may be omitted, and a separate cooking apparatus or heating device, such as an oven or microwave oven, may be disposed in the storage space.

The main body 2 may be formed to extend in the left-right direction. An upper surface 2*a* of the main body 2 may extend in the left-right direction. The heating device 3 may be installed on an upper end portion of the main body 2 while forming the external appearance of the cooking apparatus 1. The heating device 3 may form the upper surface 2*a* of the cooking apparatus 1 together with the upper surface 2*a* of the main body 2.

The heating device 3 may cook food accommodated in a container by heating the container. The heating device 3 may include at least one heater 3*a*, i.e., a first heater 3*a*-1, a second heater 3*a*-2, a third heater 3*a*-3, and a fourth heater 3*a*-4 (or a "burner") capable of heating the container. For example, the heater 3*a* may include a first heater 3*a*-1, a second heater 3*a*-2, a third heater 3*a*-3, and a fourth heater 3*a*-4. The heater 3*a* may be exposed outside of the upper surface of the heating device 3, and the container may be placed on the heater 3*a*. The number of the heaters 3*a* may vary depending on the design.

The ventilation device 100 may suction contaminated air generated during a cooking process using the heating device 3 and may purify the suctioned contaminated air and discharge the purified air to the outside of the cooking apparatus 1.

Figure 2:
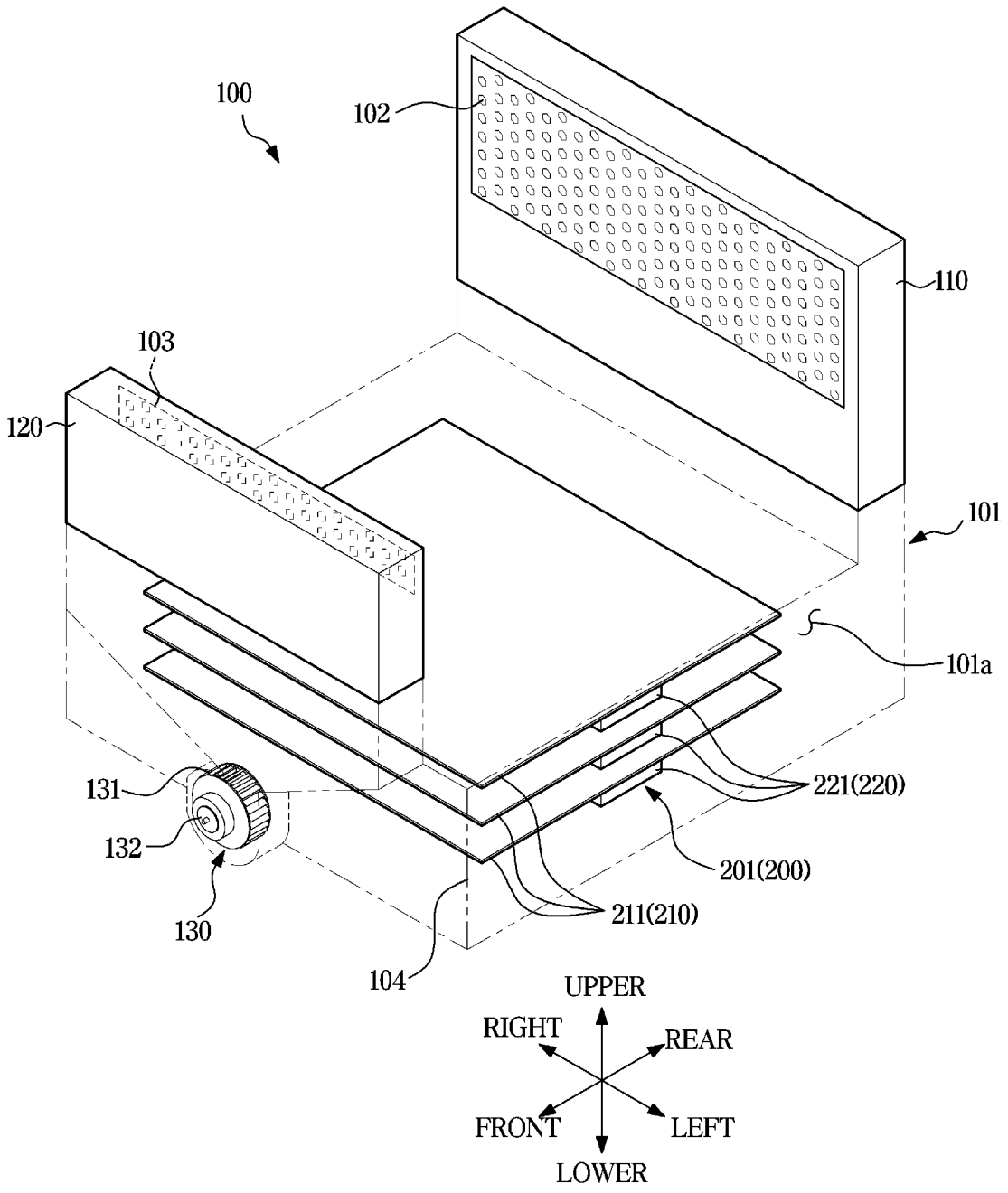
FIG. 2 illustrates example structures for a ventilation device and an oil mist collection device of the cooking apparatus shown in FIG. 1.

FIG. 2 illustrates example structures for a ventilation device and an oil mist collection device of the cooking apparatus shown in FIG. 1;

Referring to FIG. 2, the ventilation device 100 may include a ventilation device body 101 that forms a flow path 101*a* while forming the external structure of the ventilation device 100. The ventilation device body 101 may include a suction port 102 for suctioning contaminated air and a discharge port 103 for discharging air inside the ventilation device body 101.

The ventilation device body 101 may have at least a portion disposed inside the main body 2. The ventilation device body 101 may include a housing 104 disposed inside the main body 2, an intake duct 110 coupled to the housing 104 and including the suction port 102, and an exhaust duct 120 coupled to the housing 104 and including the discharge port 103. The housing 104, the intake duct 110, and the exhaust duct 120 may collectively form the flow path 101*a*. An end of the flow path 101*a* may be connected to the suction port 102, and t another end of the flow path 101*a* may be connected to the discharge port 103. At least two of the housing 104, the intake duct 110, and the exhaust duct 120 may be integrally formed. In addition, the intake duct 110 and the exhaust duct 120 may be separated from the housing 104. The intake duct 110 and the exhaust duct 120 may be provided as separate modules and installed inside the main body 2 of the cooking apparatus 1.

The ventilation device 100 may include a blower 130 provided to form an air flow in the ventilation device body 101. The blower 130 may be disposed on the flow path 101*a*.

The blower 130 may be disposed inside the ventilation device body 101 (e.g., inside the housing 104). The blower 130 may cause the air introduced into the suction port 102 to flow to the discharge port 103. The blower 130 may include a blower fan 131. The blower fan 131 may include a cross-flow fan, a sirocco fan, a mixed-flow fan, an axial fan, and a turbo fan. However, the disclosure is not limited thereto, and the blower fan 131 may include other types of fans. The blower 130 may include a motor 132 provided to rotate the blower fan 131.

The blower 130 may be disposed downstream of the flow path 101*a* from an air purification device 200, which is described below. The blower 130 may be disposed closer to the discharge port 103 than the suction port 102. The blower 130 may be disposed adjacent to the exhaust duct 120. However, the disclosure is not limited thereto, and the blower 130 may be disposed upstream of the flow path 101*a* than the air purification device 200 and at a distance to the suction port 102 shorter than a distance to the discharge port 103. However, the disclosure is not limited thereto. According to embodiments, the blower 130 may be provided in plural.

The ventilation device 100 may include the air purification device 200 that purifies (or "filters") air introduced into the ventilation device 100. For example, the air purification device 200 may include an oil mist collection device 201 that collects oil mist in the air and removes the collected oil mist. However, the disclosure is not limited thereto, and the air purification device 200 may include a filter member or a sterilization device. The air purification device 200 may be disposed inside the ventilation device body 101 (e.g., inside the housing 104).

The air purification device 200 (e.g., the oil mist collection device 201) may be disposed upstream of the flow path 101*a* than the blower 130, and remove contaminants (e.g., oil mist) in the air supplied to the blower 130. However, the disclosure is not limited thereto, and the air purification device 200 may be disposed downstream of the flow path 101*a* than the blower 130.

The oil mist collection device 201 may collect oil mist in the air to be supplied to the discharge port 103 such that air with the oil mist removed is discharged from the discharge port 103. The oil mist collection device 201 may collect oil mist in the air to be supplied to the blower 130 such that the blower 130 is prevented from contamination or malfunctioning due to exposure to the oil mist. Air flowing through the flow path 101*a* may proceed by passing through the oil mist collection device 201, the oil mist collection device 201 may remove oil mist from the air flowing through the flow path 101*a*.

The oil mist collection device 201 may be disposed on the flow path 101*a* of the ventilation device 100. The oil mist collection device 201 may be disposed inside the housing 104. Specifically, the oil mist collection device 201 may be disposed inside a purification device receiver 104*a* of the housing 104. However, the disclosure is not limited thereto, and at least a portion of the oil mist collection device 201 may be disposed inside the exhaust duct 120 and/or inside the intake duct 110.

The oil mist collection device 201 may include a plurality of the oil mist collection devices 201. For example, the oil mist collection device 201 may include a first oil mist collection device disposed in the purification device receiver 104*a* and a second oil mist collection device, at least a portion of which is disposed inside the intake duct 110.

The oil mist collection device 201 may include a collecting member 210 that allows oil mist separated from the air to adhere thereto. Specifically, the oil mist may adhere to the collecting member 210 in the form of fine oil droplets, or may adhere to the collecting member 210 in the form of fine droplets of a water-and-oil mixture of oil mist and vapor.

The collecting member 210 may be provided to be in contact with air flowing through the inside of the ventilation device body 101. The collecting member 210 may be disposed on the flow path 101*a*. The collecting member 210 may be formed of a thermally conductive material. The collecting member 210 may be formed of a metal material (e.g., aluminum, copper, stainless steel, etc.). However, the disclosure is not limited thereto, and the collecting member 210 may be formed of a material, such as plastic or glass.

A single oil mist collection device 201 may include a plurality of collecting members 210. The collecting member 210 may include a plurality of collecting members 210. For example, the plurality of collecting members 210 of the oil mist collection device 201 disposed inside the housing 104 (e.g., inside the purification device receiver 104*a*) may be spaced apart from each other inside the housing 104 (e.g., inside the purification device receiver 104*a*).

The collecting member 210 may include a plate 211. The plate 211 may have a substantially quadrangular flat plate shape. The plate 211 may be disposed in parallel with the direction of the airflow flowing through the flow path 101*a*. Specifically, the plate 211 may be disposed inside the housing 104, and may be disposed vertically or horizontally to be parallel with the direction of the airflow inside the housing 104 (e.g., inside the purification device receiver 104*a*). However, the disclosure is not limited thereto, and the collecting member 210 may include a conventional heat sink including a plurality of fins, a refrigerant tube, and the like.

The oil mist collection device 201 may be provided with a cooling device 220 provided to cool the collecting member 210 (e.g., the plate 211). The cooling device 220 may be coupled to the collecting member 210 (e.g., the plate 211). Specifically, the cooling device 220 may include a Peltier element 221 (or a "thermoelectric element") fixed to one surface of the plate 211 to cool the plate 211. The cooking apparatus 1 may include a power source (or "power"), and the Peltier element 221 supplied with power from the power source may cool the plate 211 by the Peltier effect.

However, the disclosure is not limited thereto. For example, the cooling device 220 may include a refrigerant circulating device that includes a refrigerant (e.g., water) and circulates the refrigerant, and the cooling device 220 may supply the collecting member 210 (e.g., a refrigerant pipe) with a refrigerant to cool the collecting member 210. That is, the collecting member 210 (e.g., a refrigerant pipe) may be cooled by a refrigerant (e.g., water).

As the collecting member 210 is cooled, oil mist may be condensed on the surface of the collecting member 210 and adhere in the form of oil droplets, so that the oil mist may be removed from the contaminated air.

The collecting member 210 may be detachably provided on the housing 104, and the collecting member 210 may be washable to remove the oil mist collected in the collecting member 210. However, the disclosure is not limited thereto. For example, as the oil droplets adhering to the surface of the collecting member 210 fall downward by the gravity, the oil mist collected in the collecting member 210 may be removed, and gather on the bottom surface of the housing 104 (e.g., the purification device receiver 104*a*). For another example, the oil droplets adhering to the surface of the collecting member 210 may fall downward by the gravity, and a water tank containing water or a tray containing no water may be disposed below the collecting member 210 such that oil drops separated from the collecting member 210 may gather in the water tank or tray for easy of cleaning.

Ventilation devices 100, 100', 100-1, 100-2, and 100-3 according to various embodiments to be described below may include the oil mist collection device 201, which is a type of the air purification device 200.

Figure 3:
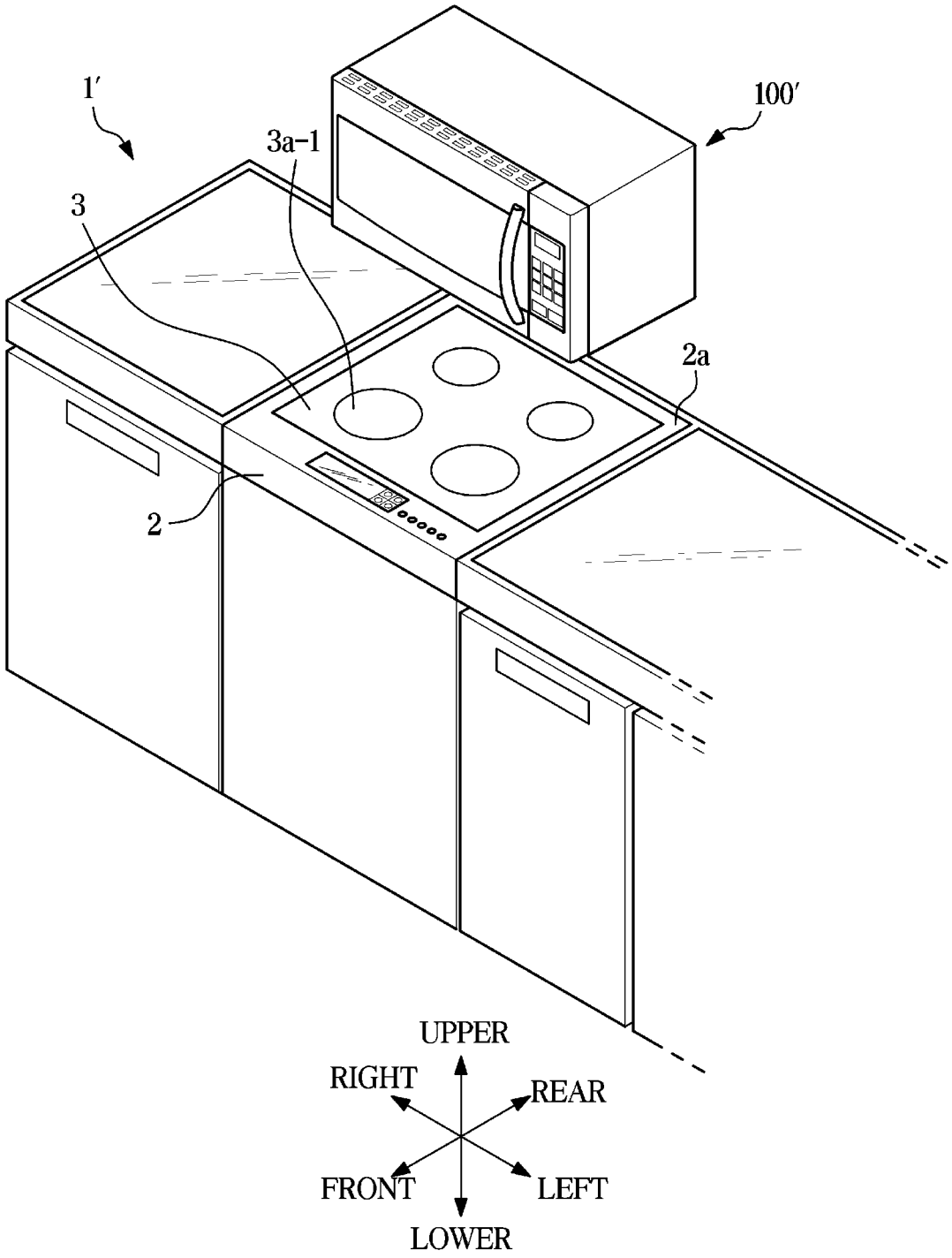
FIG. 3 illustrates an example cooking apparatus according to various embodiments of the present disclosure.
Figure 4:
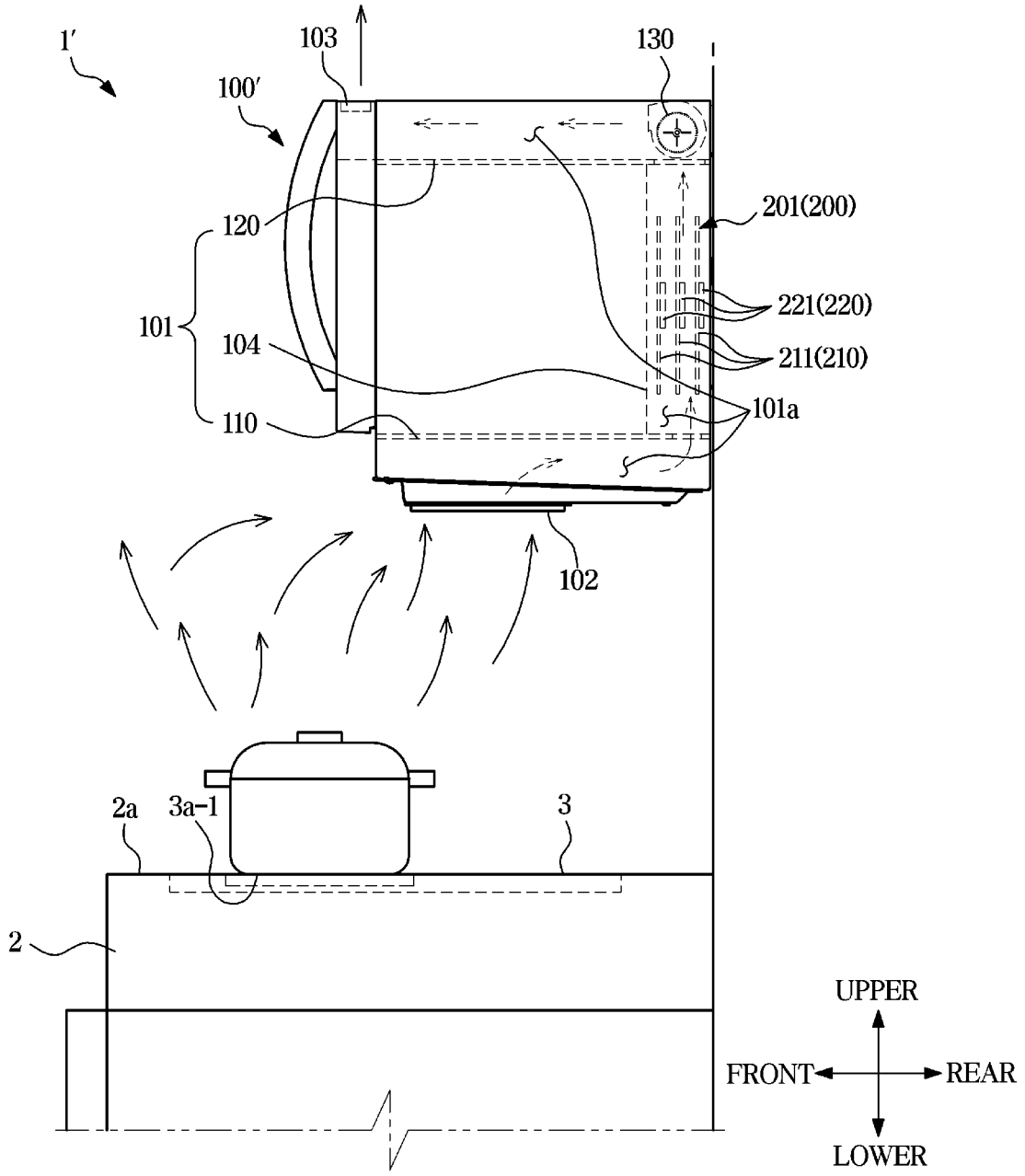
FIG. 4 is a side cross-sectional view of the cooking apparatus shown in FIG. 3.

FIG. 3 illustrates an example cooking apparatus according to various embodiments of the present disclosure. FIG. 4 is a side cross-sectional view of the cooking apparatus shown in FIG. 3.

Referring to FIGS. 3 and 4, a ventilation device 100' of a cooking apparatus 1' may be disposed above a heating device 3. For example, the ventilation device 100' may represent a kitchen hood or a wall-mounted microwave oven (or "Over The Range microwave oven"), and a ventilation device body 101 forming a flow path 101*a* may be installed above the heating device 3. In this case, a suction port 102 may be formed on a lower surface of the ventilation device body 101 to correspond to the heating device 3 and have a lower side that is openable, and the discharge port 103 may be formed on another surface (e.g., an upper surface of the ventilation device body 101) rather than the lower surface of the ventilation device body 101. The flow path 101*a* may connect the suction port 102 to the discharge port 103. The ventilation device body 101 may include a housing 104 in which the air purification device 200 is disposed, an intake duct 110 connected to the housing 104 and including the suction port 102, and an exhaust duct 120 connected to the housing 104 and including the discharge port 103. At least two of the housing 104, the intake duct 110, and the exhaust duct 120 may be integrally formed with each other.

On the other hand, the heating device 3 may be integrally or separately formed with the ventilation device 100. The heating device 3 and the ventilation device 100 may be separately manufactured and sold.

Figure 5:
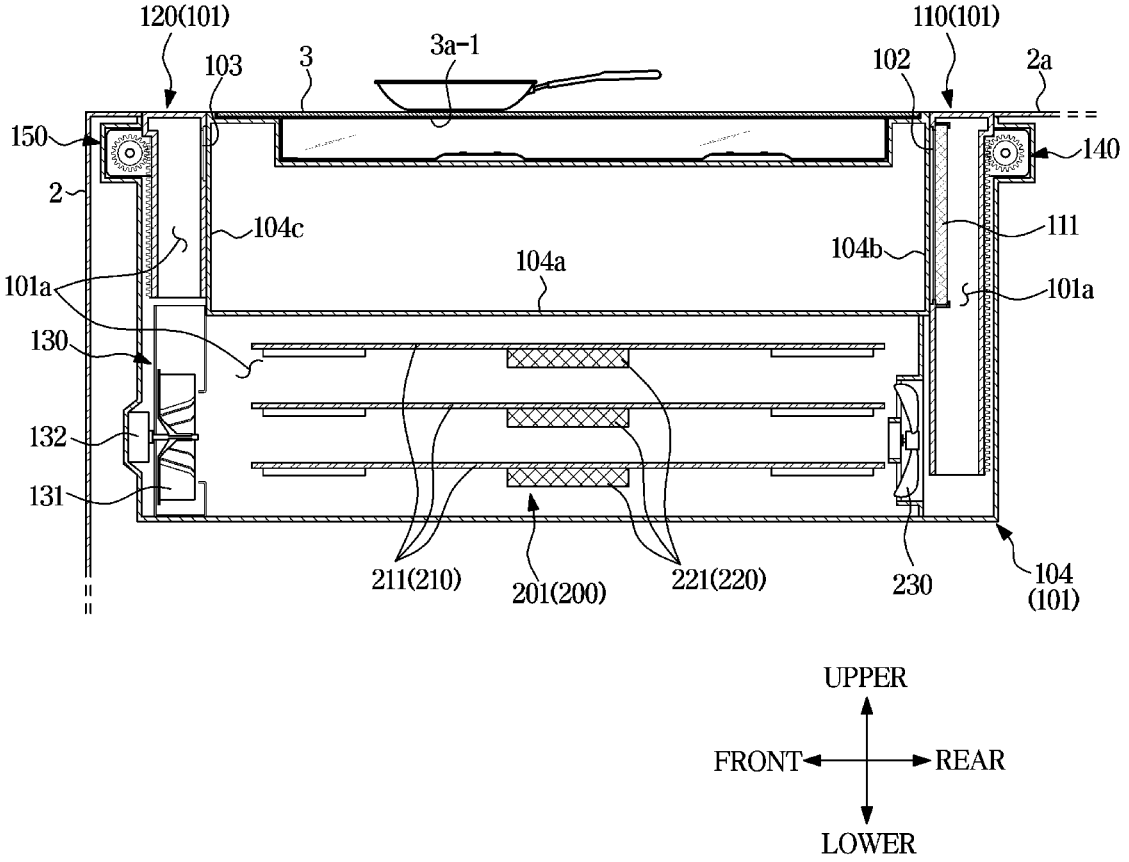
FIG. 5 is a cross-sectional side view of the cooking apparatus shown in FIG. 1, which shows a state in which the ventilation device does not operate.
Figure 6:
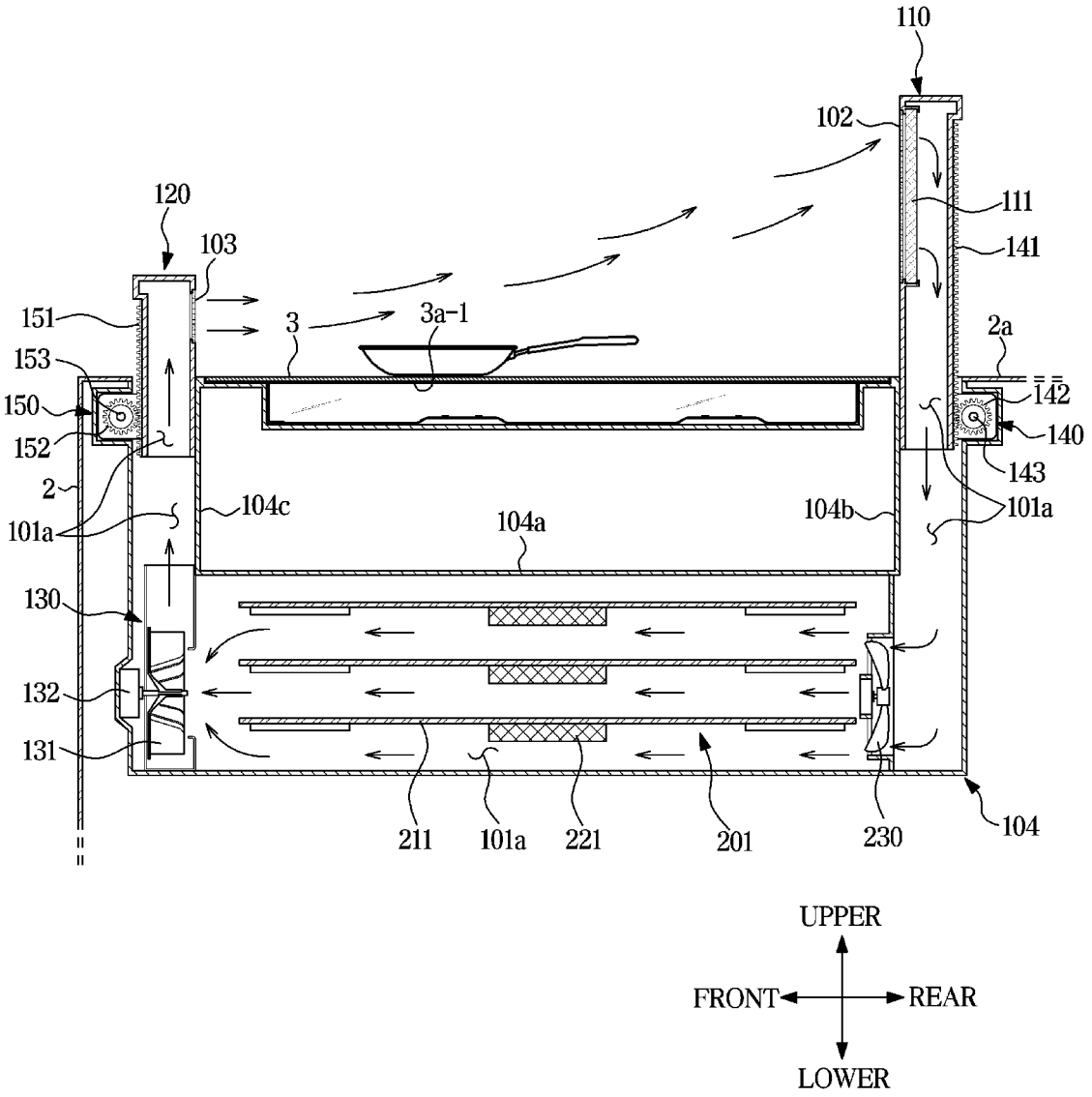
FIG. 6 is a cross-sectional side view of the cooking apparatus shown in FIG. 1, which shows a state in which the ventilation device operates.

FIG. 5 is a cross-sectional side view of the cooking apparatus shown in FIG. 1, which shows a state in which the ventilation device does not operate. FIG. 6 is a cross-sectional side view of the cooking apparatus shown in FIG. 1, which shows a state in which the ventilation device operates.

Hereinafter, the structure of the air purification device 200 and the ventilation device 100 including the same will be described in detail. The following description will be made in relation to the ventilation device 100 shown in FIGS. 1 and 2 as an example, but the disclosure is not limited thereto. The description below may also be applied to the ventilation device 100' shown in FIGS. 3 and 4.

Referring to FIGS. 5 and 6, the intake duct 110 may be provided on the first side of the heating device 3. The intake duct 110 may be provided on the first side (e.g., the rear of the heating device 3) of the heating device 3. At least a portion of the intake duct 110 may be exposed above the upper surface 2*a* of the main body 2. An upper end portion of the intake duct 110 exposed above the upper surface 2*a* of the main body 2 may be formed with the suction port 102. The intake duct 110 may include a filter 111 disposed therein and configured to filter air that is suctioned through the suction port 102. The filter 111 may include a mesh filter or a baffle filter. However, the disclosure is not limited thereto, and the filter 111 may include filters of various materials and structures that may be generally used for air filtering. The filter 111 may cover the suction port 102.

The intake duct 110 may be movably coupled to the ventilation device 100. The intake duct 110 may be moved into or out of the ventilation device 100. The intake duct 110 may be moved in upward-downward direction. For example, the intake duct 110 may slide in an upward or downward direction.

The ventilation device 100 may include a first elevation device 140 (or an "intake duct elevation device") that moves the intake duct 110 in upward and downward directions, and the intake duct 110 may be moved in upward and downward directions by the first elevation device 140. The intake duct 110 may include the first elevation device 140. The intake duct 110 and the first elevation device 140 may be formed integrally with the housing 104 of the ventilation device 100 or may be provided to be separately mounted in the ventilation device 100. The intake duct 110 and the first elevation device 140 may be provided as separate modules, and may be mounted inside the ventilation device 100.

The first elevation device 140 may include a rack 141 fixed to the intake duct 110, a pinion 142 meshed with the rack 141, and a motor 143 for rotating the pinion 142. However, the disclosure is not limited thereto, and the first elevation device 140 may include a scissor lift that is coupled to a side (e.g., a lower or upper side) of the intake duct 110 to move the intake duct 110 in the upward and downward directions, or may include a hydraulic cylinder coupled to a side (e.g., a lower side, or upper side) of the intake duct 110 to move the intake duct 110 in upward and downward directions. The first elevation device 140 may include various power sources and power transmission structures capable of moving the intake duct 110 in upward and downward directions.

The exhaust duct 120 may be provided on the second side of the heating device 3. The exhaust duct 120 may be disposed on the second side (e.g., the front of the heating device 3) of the heating device 3. The intake duct 110 and the exhaust duct 120 may be disposed to face each other. At least a portion of the exhaust duct 120 may be exposed above the upper surface 2*a* of the main body 2. An upper end portion of the exhaust duct 120 exposed above the upper surface 2*a* of the main body 2 may be formed with the discharge port 103. The exhaust duct 120 may be disposed above the blower 130.

The exhaust duct 120 may be movably coupled to the ventilation device 100. The exhaust duct 120 may move into or out of the ventilation device 100. The exhaust duct 120 may be movable in the upward-downward directions. For example, the exhaust duct 120 may slide in an upward or downward direction. The movement of the exhaust duct 120 and the movement of the intake duct 110 may be independent of each other.

The ventilation device 100 may include a second elevation device 150 (or an "exhaust duct elevation device") that moves the exhaust duct 120 in upward and downward directions, and the exhaust duct 120 may be moved in upward and downward directions by the second elevation device 150. The exhaust duct 120 may include the second elevation device 150. The exhaust duct 120 and the second elevation device 150 may be formed integrally with the housing 104 of the ventilation device 100 or may be provided to be separately mounted in the ventilation device 100. The exhaust duct 120 and the second elevation device 150 may be provided as separate modules, and may be mounted inside the ventilation device 100.

The second elevation device 150 may include a rack 151 fixed to the exhaust duct 120, a pinion 152 meshed with the rack 151, and a motor 153 for rotating the pinion 152. However, the disclosure is not limited thereto, and the second elevation device 150 may include a scissor lift that is coupled to one side (e.g., a lower or upper side) of the exhaust duct 120 to move the exhaust duct 120 in the upward and downward directions or may include a hydraulic cylinder coupled to one side (e.g., a lower side, or an upper side) of the exhaust duct 120 to move the exhaust duct 120 in the upward or downward directions. The second elevation device 150 may include various power sources and power transmission structures capable of moving the exhaust duct 120 in the upward and downward directions. The first elevation device 140 and the second elevation device 150 may operate independently of each other.

The suction port 102 may move together with the intake duct 110. The discharge port 103 may move together with the exhaust duct 120. As the intake duct 110 moves in one direction (e.g., an upward direction or downward direction), the suction port 102 may be exposed to the outside of the housing 104 or hidden inside the housing 104. As the exhaust duct 120 moves in one direction (e.g., an upward direction or downward direction), the discharge port 103 may be exposed to the outside of the housing 104 or hidden inside the housing 104. That is, the suction port 102 may be exposed above the upper surface 2*a* of the main body 2 or may be hidden below the upper surface of the main body 2 by a movement of the intake duct 110. In addition, the discharge port 103 may be exposed above the upper surface 2*a* of the main body 2 or may be hidden below the upper surface of the main body 2 by a movement of the exhaust duct 120.

The housing 104 may include a purification device receiver 104*a* in which the air purification device 200 (e.g., the oil mist collection device 201) is disposed, an intake duct receiver 104*b* that communicates with the purification device receiver 104*a* and allows the intake duct 110 to be movable coupled thereto while accommodating the intake duct, and an exhaust duct receiver 104*c* that communicates with the purification device receiver 104*a* and allows the exhaust duct 120 to be movably coupled thereto while accommodating the exhaust duct 120.

When the intake duct 110 with the suction port 102 exposed to the outside of the main body 2 moves downward, a portion of the intake duct 110 accommodated in the intake duct receiver 104*b* may increase. The downward movement of the intake duct 110 may cause the suction port 102 to be accommodated in the intake duct receiver 104*b* and hidden without exposure to the outside of the housing 104.

When the exhaust duct 120 moves downward, a portion of the exhaust duct 120 accommodated in the exhaust duct receiver 104*c* may increase. The downward movement of the exhaust duct 120 may cause the discharge port 103 to be accommodated in the exhaust duct receiver 104*c* and hidden without exposure to the outside of the housing 104.

At least two of the exhaust duct receiver 104*c*, the intake duct receiver 104*b*, may be integrally formed with the purification device receiver 104*a*.

When the intake duct 110 with the suction port 102 hidden moves upward, the suction port 102 may be exposed to an upper area of the main body 2. When the exhaust duct 120 with the discharge port 103 hidden moves upward, the discharge port 103 may be exposed to an upper area of the main body 2. The upper area of the main body 2 may refer to an external space above the upper surface 2*a* of the main body 2 and may refer to a space in which contaminated air generated during a cooking process using the heating device 3 is spread.

In a state in which the ventilation device 100 does not operate, the suction port 102 and the discharge port 103 may be hidden inside the main body 2. When the ventilation device 100 operates, the suction port 102 and/or the discharge port 103 may be exposed to the upper area of the main body 2 by a movement of the intake duct 110 and/or the exhaust duct 120.

The discharge port 103 may discharge air toward the suction port 102. Contaminated air suctioned through the suction port 102 may reach the air purification device 200 (e.g., the oil mist collection device 201) along the flow path 101*a*, and while passing through the air purification device 200, the contaminated air may be purified. The air purified by the air purification device 200 may be supplied to the blower 130, and the air introduced into the blower 130 may be blown to the discharge port 103. The air blown by the blower 130 may be discharged toward the suction port 102 through the discharge port 103. The air discharged through the discharge port 103 toward the suction port 102 may cause the contaminated air in the vicinity of the front of the heating device 3 to be moved to the suction port 102, so that the ventilation effect of the ventilation device 100 may be increased.

A user may cook food in front of the cooking apparatus 1. Because the discharge port 103 of the ventilation device 100 is located between the heating device 3 and the user, the air discharged from the discharge port 103 toward the rear of the heating device 3 may block contaminated air from spreading to the user. That is, the air discharged from the discharge port 103 to the suction port 102 may form an "air curtain".

In addition, a plurality of blowers 130 and 230 may be provided in the ventilation device 100. For example, the blower may be provided in each of a lower portion of the intake duct 110 and a lower portion of the exhaust duct 120. The blower disposed downstream of the flow path 101*a* than the air purification device 200 may be referred to as a first blower 130 (a "discharge blower"). In addition, a second blower 230 (a "suction blower") may be provided upstream of the flow path 101*a* than the air purification device 200. In this case, the air purification device 200 may be disposed between the first blower 130 and the second blower 230 along the flow path 101*a*. The first blower 130 may be disposed in the lower portion of the exhaust duct 120, and the second blower 230 may be disposed in the lower portion of the intake duct 110. The first blower 130 and the second blower 230 may operate independently of each other. The second blower 230 may suction contaminated air into the ventilation device body 101 through the suction port 102. The first blower 130 may discharge air purified by the air purification device 200 to the outside of the ventilation device body 101 through the discharge port 103. Meanwhile, the second blower 230 may be omitted. The first blower 130 and the exhaust duct 120 may be integrally formed and provided as one module or may be provided as separate modules. The second blower 230 and the intake duct 110 may also be integrally formed and provided as one module or may be provided as separate modules.

The ventilation device 100 may include the flow path 101*a* for guiding the air introduced through the suction port 102 to the discharge port 103. The flow path 101*a* may be formed by the intake duct 110, the exhaust duct 120, and the housing 104. The flow path 101*a* may be spaced apart from the heating device 3. The housing 104 may be spaced apart from the heating device 3.

Figure 7:
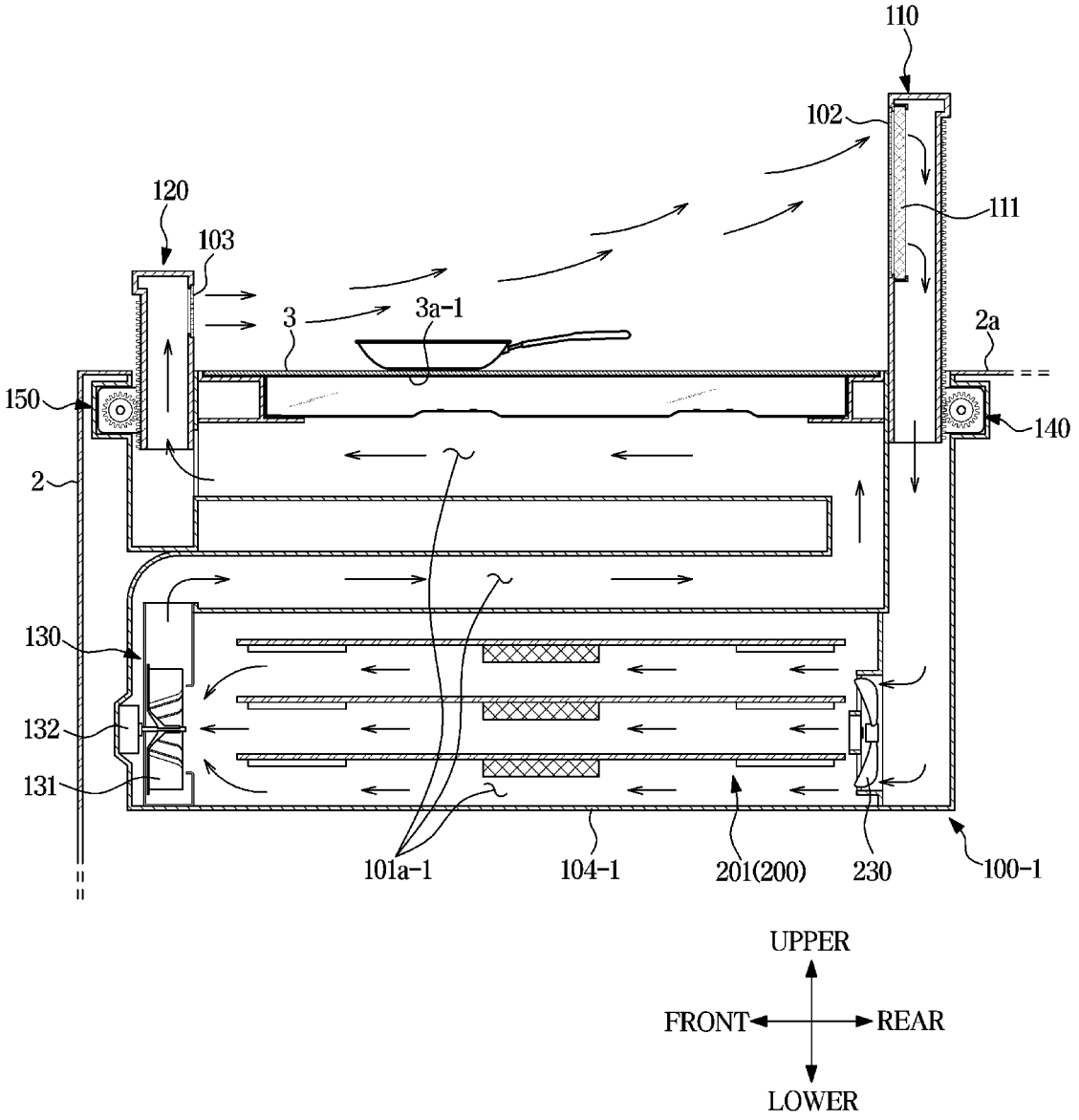
FIG. 7 is a side cross-sectional view of an example cooking apparatus including a ventilation device according to various embodiments of the present disclosure.

FIG. 7 is a side cross-sectional view of a cooking apparatus including a ventilation device according to various embodiments of the present disclosure.

The construction of the ventilation device 100 described in FIGS. 5 and 6 may also be applied to a ventilation device 100-1 as illustrated in FIG. 7.

Referring to FIG. 7, a flow path 101*a*-1 of the ventilation device 100-1 may be connected to (or communicate with) a heating device 3 and may supply air blown by a blower 130 to the heating device 3. The heating device 3 may be disposed on the flow path 101*a*-1 of the ventilation device 100-1.

A housing 104-1 may be coupled in communication with the heating device 3, and the air discharged from the blower 130 may be guided to the heating device 3 by the flow path 101*a*-1 formed by the housing 104-1, to thereby cool the heating device 3. In other words, the heating device 3 may be disposed on the flow path 101*a*-1 of the ventilation device 100-1, and the heating device 3 may be disposed downstream of the flow path 101*a*-1 than the blower 130 and may be disposed upstream of the flow path 101*a*-1 than the discharge port 103. The air discharged from the blower 130 may, while cooling the heating device 3, pass through the heating device 3, to be guided to the discharge port 103 and discharged.

Although the blower 130 may be disposed inside the housing 104-1, the disclosure is not limited thereto. The blower 130 including a blower fan 131 may be disposed in the heating device 3 disposed on the flow path 101*a*-1. In this case, the blower fan 131 may be referred to as a cooling fan of the heating device 3, and the blower 130 and the blower fan 131 may be considered as a component of the heating device. That is, the cooling fan of the heating device 3 may form an airflow in the flow path 101*a*-1 of the ventilation device 100-1.

Figure 8:
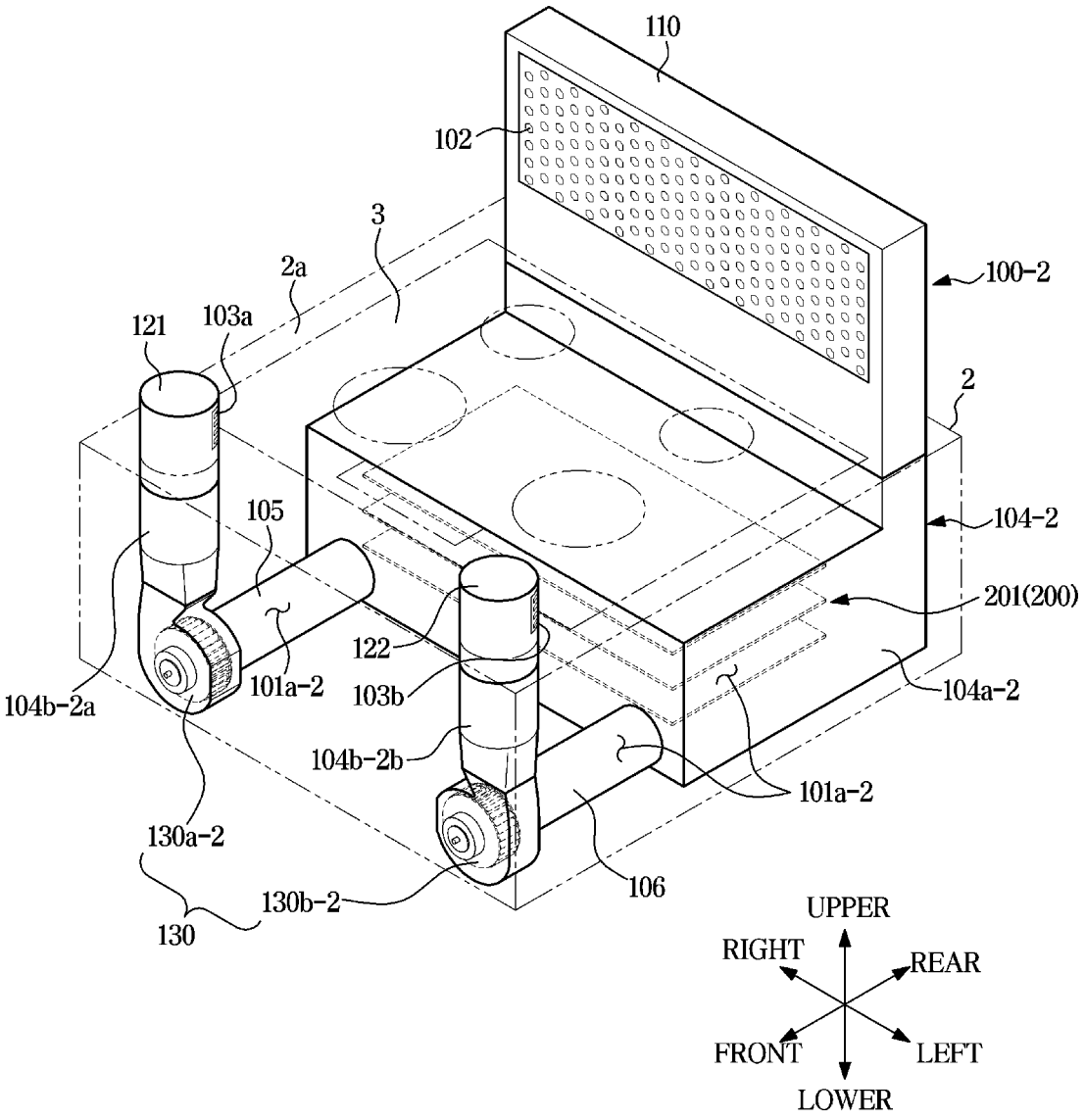
FIG. 8 illustrates an example cooking apparatus including a ventilation device according to various embodiments of the present disclosure.

FIG. 8 illustrates an example cooking apparatus including a ventilation device according to various embodiments of the present disclosure.

The construction of the ventilation device 100 described in FIGS. 5 and 6 may also be applied to a ventilation device 100-2 as illustrated in FIG. 8.

Referring to FIG. 8, the ventilation device 100-2 may include a plurality of exhaust ducts 121 and 122. The plurality of exhaust ducts 121 and 122 may be rotatable about a rotation axis extending in one direction (e.g., in an upper-lower direction). Each of the plurality of exhaust ducts 121 and 122 may rotate about a rotation axis extending in an upper-lower direction.

The plurality of exhaust ducts 121 and 122 may include a first exhaust duct 121 and a second exhaust duct 122. A discharge port formed in the first exhaust duct 121 may be referred to as a first discharge port 103*a*, and a discharge port formed in the second exhaust duct 122 may be referred to as a second discharge port 103*b*. The intake duct 110 is illustrated as a single unit, but the disclosure is not limited thereto, and a plurality of intake ducts (e.g., a first intake duct and a second intake duct) may be provided to correspond to the plurality of exhaust ducts 121 and 122.

The second exhaust duct 122 may be provided to be spaced apart from the first exhaust duct 121 at a side of a heating device 3. For example, the first exhaust duct 121 and the second exhaust duct 122 may be disposed at a left front side and a right front side of the heating device 3, respectively. The first exhaust duct 121 and the second exhaust duct 122 may be disposed symmetrically with respect to a center in a left-right direction of the heating device 3.

A first branch 105 and a second branch 106 may be provided inside the housing 104-2. The first branch 105 and the second branch 106 are connected to the purification device receiver 104*a*-2 and guide air to the first exhaust duct 121 and the second exhaust duct 122, respectively. The first branch 105 may correspond to the first exhaust duct 121, and the second branch 106 may correspond to the second exhaust duct 122.

Exhaust duct receivers 104*b*-2*a*, 104*b*-2*b* may include a first exhaust duct receiver 104*b*-2*a* connected to the first branch 105 and allowing the first exhaust duct 121 to be movably coupled thereto, and a second exhaust duct receiver 104*b*-2*b* connected to the second branch 106 and allowing the second exhaust duct 122 to be movably coupled thereto. The first branch 105 may be integrally formed with the first exhaust duct receiver 104*b*-2*a*. The second branch 106 may be integrally formed with the second exhaust duct receiver 104*b*-2*b*.

The blower 130 (or the "discharge blower") may include a third blower 130*a*-2 that discharges air toward the first exhaust duct 121 and a fourth blower 130*b*-2 that discharges air toward the second exhaust duct 122. The third blower 130*a*-2 may communicate with the first branch 105. The third blower 130*a*-2 may be disposed inside the first branch 105. The fourth blower 130*b*-2 may communicate with the second branch 106. The fourth blower 130*b*-2 may be disposed inside the second branch 106. The first exhaust duct 121, the first branch 105, and the third blower 130*a*-2 may be provided as one module. The second exhaust duct 122, the second branch 106, and the fourth blower 130*b*-2 may also be provided as one module.

The third blower 130*a*-2 and the fourth blower 130*b*-2 may operate independently of each other. The third blower 130*a*-2 and the fourth blower 130*b*-2 may be controlled by a processor 182. When the third blower 130*a*-2 operates, air may be discharged through the first discharge port 103*a* formed in the first exhaust duct 121, and when the fourth blower 130*b*-2 operates, air may be discharged through the second discharge port 103*b* formed in the second exhaust duct 122. The blower fan of the third blower 130*a*-2 and the blower fan of the fourth blower 130*b*-2 may rotate at the same or different speeds. The third blower 130*a*-2 and the fourth blower 130*b*-2 may supply air having the same or different flow rates to the first exhaust duct 121 and the second exhaust duct 122, respectively. Accordingly, the first discharge port 103*a* and the second discharge port 103*b* may discharge air having the same or different flow rates.

However, the disclosure is not limited thereto. For example, the ventilation device 100-2 may include a flow distribution device disposed inside the housing 104-2. The first exhaust duct 121 and the second exhaust duct 122 may be coupled to one side of the housing 104-2. The flow distribution device may be disposed downstream of the flow path 101*a*-2 than the blower 130 and may be disposed upstream of the flow path 101*a*-2 than the first exhaust duct 121 and the second exhaust duct 122. Air discharged from the blower 130 may be distributed to the first exhaust duct 121 and the second exhaust duct 122 by the flow distribution device.

The first exhaust duct 121 and the second exhaust duct 122 may rotate in the left and right directions with respect to a rotation axis extending in the upper and lower direction. As the first exhaust duct 121 and the second exhaust duct 122 rotate in the left and right directions, the first direction of the first discharge port 103*a* and the second direction of the second discharge port 103*b* may be adjusted. The first exhaust duct 121 and the second exhaust duct 122 may be rotated manually or automatically.

The first exhaust duct 121 and the second exhaust duct 122 may each include a rotating device. The rotating devices may include a first rotating device rotating the first exhaust duct 121 and a second rotating device rotating the second exhaust duct 122. The rotating device may include a motor and a plurality of gears, but the disclosure is not limited thereto. That is, the rotating device may be variously provided as long as it can rotate each of the first exhaust duct 121 and the second exhaust duct 122 using power.

The first exhaust duct 121 and the second exhaust duct 122 may be moved to the outside or inside of the ventilation device 100-2. The first exhaust duct 121 and the second exhaust duct 122 may be movable in the upward and downward directions. For example, each of the first exhaust duct 121 and the second exhaust duct 122 may include an elevation device 251, 252. The elevation devices (or "exhaust duct elevation devices") 251, 252 may include a third elevation device 251 that moves the first exhaust duct 121 upward and downward and a fourth elevation device 252 that moves the second exhaust duct 122 upward and downward.

The first exhaust duct 121 may be moved in the upward and downward directions by the third elevation device 251 and may be rotated in the left and right directions by the first rotating device. The second exhaust duct 122 may be moved in the upward and downward directions by the fourth elevation device 252 and may be rotated in the left and right directions by the second rotating device.

For example, the first rotating device and the second rotating device (e.g., a motor) may be fixed to the third elevation device 251 and the fourth elevation device 252 (e.g., a scissor lift or a hydraulic cylinder). The first rotating device may be coupled to the first exhaust duct 121, and the second rotating device may be coupled to the second exhaust duct 122. By the third elevation device 251, the first rotating device and the first exhaust duct 121 may be moved together in the upward and downward direction. By the fourth elevation device 252, the second rotating device and the second exhaust duct 122 may be moved together in the upward and downward directions. In a state in which the first discharge port 103*a* is exposed to the upper area of the main body 2, the first rotating device may rotate the first exhaust duct 121. In a state in which the second discharge port 103*b* is exposed to the upper area of the main body 2, the second rotating device may rotate the second exhaust duct 122. The elevation devices 251, 252 and the rotating devices may be controlled by the processor 182.

However, the disclosure is not limited thereto. The elevation device may be omitted. At least a portion of the first exhaust duct 121 and at least a portion of the second exhaust duct 122 may be formed to be protruded or exposed above the upper surface 2*a* of the main body 2 such that the first discharge port 103*a* and the second discharge port 103*b* are exposed to the upper area of the main body 2. The first exhaust duct 121 and the second exhaust duct 122 may be rotatably coupled to the housing 104-2. The first exhaust duct 121 and the second exhaust duct 122 may be rotated manually or automatically.

Figure 9:
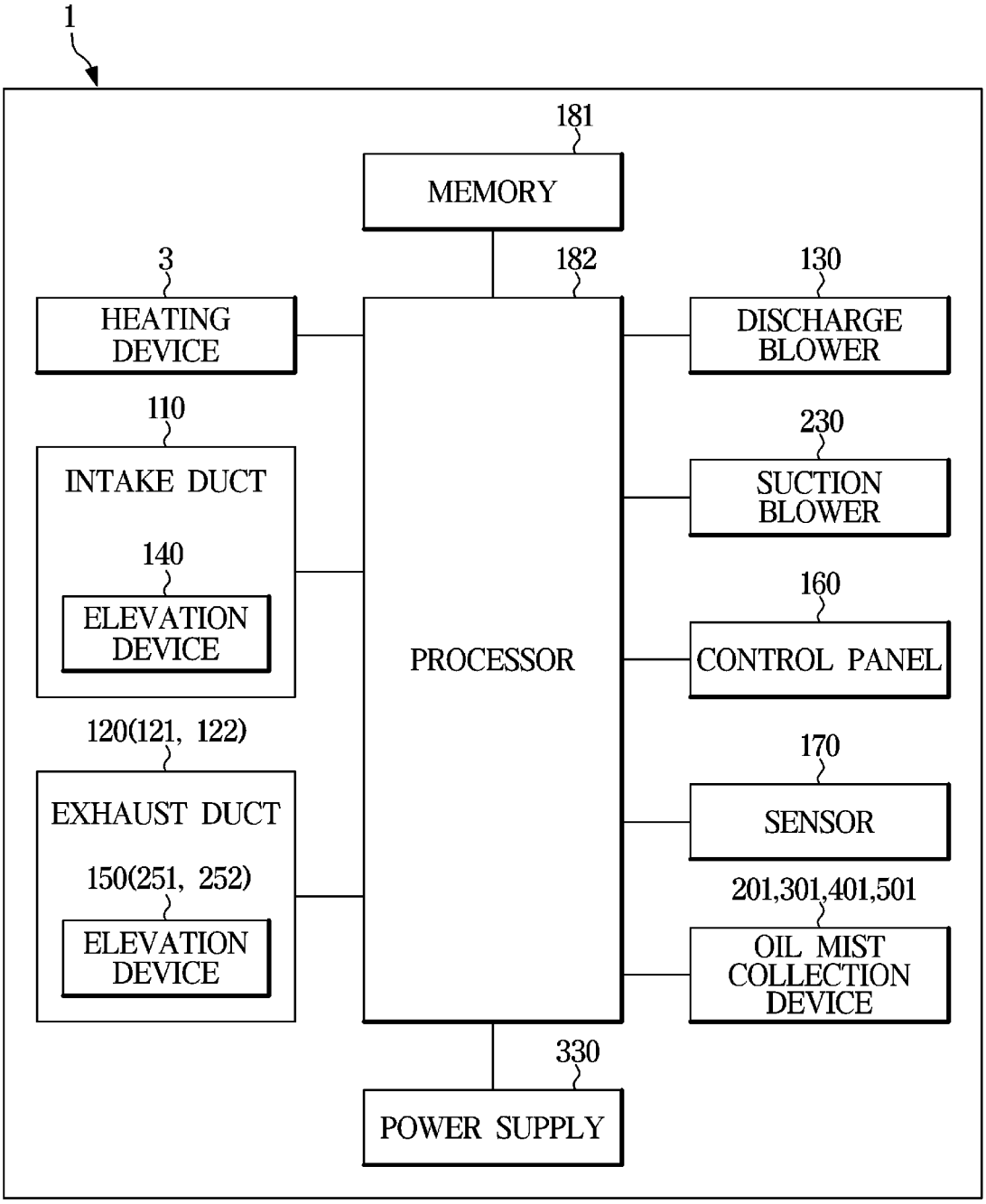
FIG. 9 is a control block diagram of an example cooking apparatus according to various embodiments of the present disclosure.

FIG. 9 is a control block diagram of an example cooking apparatus according to various embodiments of the present disclosure.

Referring to FIG. 9, a cooking apparatus 1 may include a heating device 3, an intake duct 110, an exhaust duct 120, a discharge blower 130, a suction blower 230, a control panel 160, a sensor 170, an oil mist collection device 201, 301, 401, or 501, a power supply 330, a memory 181, and a processor 182. The processor 182 may be electrically connected to the components of the cooking apparatus 1 and may control operations of the components of the cooking apparatus 1. The processor 182 may control the heating device 3, the intake duct 110, the exhaust duct 120, the discharge blower 130, the suction blower 230, the control panel 160, the sensor 170, and the oil mist collection device 201, 301, 401, or 501.

The intake duct 110, the exhaust duct 120, the discharge blower 130, and the suction blower 230 are the same as described above. The oil mist collection device 201 has been described above, and the oil mist collection devices 301, 401, and 501 according to embodiments will be described below.

The heating device 3 may be located between the intake duct 110 and the at least one exhaust duct 120, i.e., first exhaust duct 121 and second exhaust duct 122. The heating device 3 may be one of various types of devices. For example, the heating device 3 may represent an induction heating device, a highlight electric stove or a gas stove.

When the heating device 3 is an induction heating device, the heating device 3 may include a heating coil and a driving circuit for applying a current to the heating coil. The heating coil and the driving circuit may be provided inside the heating device 3. The heating coil may be provided at a position corresponding to a heater 3*a*. The heating coil may generate a magnetic field and/or an electromagnetic field based on a current applied from the drive circuit. Due to the magnetic field generated by the heating coil, a container located in the heater 3*a*, i.e., the first heater 3*a*-1, the second heater 3*a*-2, the third heater 3*a*-3, and the fourth heater 3*a*-4 may be heated.

The control panel 160 may be disposed on an upper surface 2*a* of the main body 2, an upper surface of the heating device 3, or an upper surface of the exhaust duct 120. The user may operate the control panel 160 to select whether to move the intake duct 110, whether to move the exhaust duct 120, and/or the rotation speed of the blower 130. The processor 182 may control the operation of the cooking apparatus 1 based on a command input through the control panel 160. The control panel 160 may include an inputter for obtaining a user input, and a display for displaying operation information of the cooking apparatus 1 in response to the user input.

The display of the control panel 160 may display operation information of the cooking apparatus 1. For example, the display may display an operation mode of the cooking apparatus 1, a burner on which a container is placed among a plurality of burners, a heating power set in the burner in operation, an operation state of the intake duct 110, an operation state of the exhaust duct 120, and/or an operation state of the blowers 130 and 230. In addition, the control panel 160 may display various types of information regarding the cooking apparatus 1. The display may include a liquid crystal display (LCD) panel and/or a light emitting diode (LED) panel.

The inputter of the control panel 160 may include various buttons. For example, the control panel 160 may include a power button for powering on or off the cooking apparatus 1, an operation button for starting or temporarily stopping the operation of the heating device 3, a selection button for selecting a control target heater among the plurality of heaters 3*a*, a heating power button for adjusting the heating power of a control target heater, and/or a position adjustment button for adjusting the positions of the intake duct 110 and the exhaust duct 120. In addition, the control panel 160 may include various buttons. The buttons of the control panel 160 may include a tact switch, a push switch, a slide switch, a toggle switch, a micro switch, or a touch switch. In addition, the buttons may include light emitting diodes.

In addition, the control panel 160 may include a rotatable dial. According to the rotation of the dial, selection of the heater 3*a* and adjustment of the heating power of the heater 3*a* may be performed. In addition, the positions of the intake duct 110 and the exhaust duct 120 may be adjusted according to the rotation of the dial. Meanwhile, the control panel 160 may be provided as a touch screen in which the display is integrally implemented with the inputter.

The sensor 170 may measure at least one of the size of the container placed on the heater 3*a* and the position of the container. The size of the container may include the height of the container, the diameter of the container, the width of the container, and the volume of the container. The sensor 170 may be disposed in the main body 2, the intake duct 110, the exhaust duct 120, and/or the heating device 3. For example, the sensor 170 may be disposed in the intake duct 110, and may be exposed to the upper space of the main body 2 together with the suction port 102 when the suction port 102 is exposed to the outside of the main body 2.

The sensor 170 may transmit at least one of size data of the container and position data of the container to the processor 182. The processor 182 may identify the size of the container and the position of the container based on the data transmitted from the sensor 170. In addition, the processor 182 may identify the type of the container based on the data transmitted from the sensor 170.

The sensor 170 may include at least one of an image sensor, such as a camera, a non-image sensor, such as a radar, and an optical sensor. The image sensor, such as a camera, may photograph an object and acquire image data. The non-image sensor, such as a radar, may transmit a radio wave to an object, receive a radio wave reflected from a cooking object, and detect the object using the transmitted radio wave and the received radio wave. The optical sensor may transmit light to an object and receive light reflected from the object to detect the object.

When the sensor 170 is provided in the heating device 3, the sensor 170 may include a capacitance sensor capable of detecting a change in capacitance due to a container placed on the heater 3*a*. In addition, the sensor 170 may include at least one of an infrared sensor, a micro switch, and a membrane switch. In addition, the sensor 170 may be implemented as various sensors.

Meanwhile, the sensor 170 may be omitted from the cooking apparatus 1. The processor 182 may detect at least one of the position of the container, the size of the container, and the type of the container based on the inductance of a heating coil that changes by the container placed on the heater 3*a*. The inductance of the heating coil measured when a container is placed on the upper portion of the heating coil is different from that measured when a container is not placed on the upper portion of the heating coil. In addition, sensing of the container may be performed by various methods.

The power supply 330 may receive power from an external power source, rectify the received power, and provide the rectified power to the components of the cooking apparatus 1. The processor 182 may distribute the power transmitted from the power supply 330 to the intake duct 110, the exhaust duct 120, the discharge blower 130, the suction blower 230, the control panel 160, the sensor 170, and the oil mist collection device 201, 301, 401, or 501. Alternatively, the power supply 330 may directly supply power to each of the components of the cooking apparatus 1 under the control of the processor 182.

The memory 181 may include a volatile memory (e.g., a static random-access memory (S-RAM) or a dynamic random-access memory (D-RAM)) and a non-volatile memory (e.g., a read-only memory (ROM) or erasable prom (EPROM)). The processor 182 and the memory 181 may be implemented as separate chips or as a single chip. In addition, a plurality of processors and a plurality of memories may be provided.

The processor 182 may process data and signals using a program provided from the memory 181, and may provide a control signal to each component of the cooking apparatus 1. The processor 182 may include an arithmetic circuit, a memory circuit, and a control circuit. In addition, the processor 182 may include a single core or a plurality of cores.

The memory 181 may store programs, instructions, and data for controlling the operation of the cooking apparatus 1. The processor 182 may generate a control signal for controlling the operation of the cooking apparatus 1 based on the program, instruction, and data memorized and/or stored in the memory 181.

The memory 181 and the processor 182 may be provided inside the main body 2, the housing 104, the intake duct 110, the exhaust duct 120, or the heating device 3. The processor 182 may control the operation of the blowers 130 and 230, the movement of the intake duct 110, and the movement of the exhaust duct 120 based on signals transmitted from the control panel 160 and/or the sensor 170. For example, the processor 182 may control the first elevation device 140 to adjust the position of the intake duct 110, and may control the second elevation device 150 to adjust the position of the exhaust duct 120. In addition, the processor 182 may control the motors of the blowers 130 and 230 to adjust the rotation speed of the blower fan.

The processor 182 may adjust the positions of the intake duct 110 and the at least one exhaust duct 120, based on identification of a container placed on the heater 3*a* (or a "burner") of the heating device 3. The exhaust duct 120 may be provided in a single unit or a plurality of units thereof. Adjusting the position for each of the intake duct 110 and the exhaust duct 120 may include adjusting the elevation height and/or adjusting the rotation direction.

In addition, the processor 182 may select the heater 3*a* (which is called burner) to be operated based on a user input obtained by the control panel 160. The processor 182 may adjust the respective positions of the intake duct 110 and the at least one exhaust duct 120 based on selection of the burner by the user input. That is, the processor 182 may determine the operation of the intake duct 110 and the operation of the at least one exhaust duct 120 based on the position of the burner to be controlled. The processor 182 may determine the position of the intake duct 110 and the position of the at least one exhaust duct 120 based on the position of the burner to be controlled. The processor 182 may adjust the position of the intake duct 110 and the position of the at least one exhaust duct 120 in consideration of both the selection of the burner by the user input and the identification of the container.

The processor 182 may adjust the elevation height for each of the intake duct 110 and the at least one exhaust duct 120 based on the size of the container. The processor 182 may adjust the elevation height for each of the intake duct 110 and the at least one exhaust duct 120 such that the suction port 102 of the intake duct 110 and the discharge port 103 of the exhaust duct 120 are located at positions higher than the position of the container. For example, the processor 182 may control the first elevation device 140 that raises or lowers the intake duct 110 to adjust the elevation height of the intake duct 110. The processor 182 may control the second elevation device 150 that raises or lowers the exhaust duct 120 to adjust the elevation height of the exhaust duct 120.

Air discharged from the discharge port 103 of the exhaust duct 120 needs to be moved to the suction port 102 of the intake duct 110. However, when a movement path of the air is blocked by the container, the air discharged from the discharge port 103 may not reach the suction port 102. In this case, contaminated air generated from the container during cooking may not move to the suction port 102. In order to secure a movement path of the air discharged from the discharge port 103 of the exhaust duct 120, the position for each of the intake duct 110 and the at least one exhaust duct 120 may be individually adjusted.

Meanwhile, the processor 182 may adjust the elevation height for each of the intake duct 110 and the at least one exhaust duct 120 based on an operation mode selected through the control panel 160. The operation mode of the cooking apparatus 1 may include a pan mode and a pot mode. The pan mode is a mode for cooking using a container having a relatively small height, such as a frying pan. The pot mode is a mode for cooking using a container having a relatively large height, such as a pot. The elevation height for each of the intake duct 110 and the exhaust duct 120 in the pan mode may be smaller than the elevation height for each of the intake duct 110 and the exhaust duct 120 in the pot mode. The elevation height of the intake duct 110 and the elevation height of the exhaust duct 120 may be predetermined for each operation mode of the cooking apparatus 1.

As shown in FIG. 8, the exhaust duct 120 may be provided in a plurality of units thereof, and may include a first exhaust duct 121 and a second exhaust duct 122. The first exhaust duct 121 may include a first discharge port 103*a*, and the second exhaust duct 122 may include a second discharge port 103*b*. The processor 182 may adjust the first elevation height of the intake duct 110 based on the size of the container placed on the heater 3*a* of the heating device 3 or the operation mode of the cooking apparatus. In addition, the processor 182 may adjust the second elevation height of the first exhaust duct 121 and the third elevation height of the second exhaust duct 122 to be the same or different based on the size of the container or the operation mode of the cooking apparatus. The pan mode or the pot mode may be separately set for each of the plurality of exhaust ducts 121 and 122.

For example, containers having different sizes may be arranged on the first heater 3*a*-1 adjacent to the first exhaust duct 121 and the second heater 3*a*-2 adjacent to the second exhaust duct 122, respectively. A pot having a relatively large height may be placed on the first heater 3*a*-1, and a pan having a relatively small height may be placed on the second heater 3*a*-2. In this case, the elevation height of the first exhaust duct 121 may be adjusted to be greater than the elevation height of the second exhaust duct 122. Even when containers of different sizes are simultaneously arranged on the heating device 3, spread of contaminated air may be effectively prevented by individually adjusting the positions of the plurality of exhaust ducts 121 and 122.

In addition, the processor 182 may rotate the at least one exhaust duct 121 and 122 such that the discharge ports 103, i.e., 103*a* and 103*b* face the container and/or the burner selected by the user input. The processor 182 may adjust the directions of the exhaust ducts 121 and 122 based on the position of the container. The processor 182 may adjust the first rotation angle of the first exhaust duct 121 and the second rotation angle of the second exhaust duct 122 such that the first discharge port 103*a* and the second discharge port 103*b* face the container. By allowing air discharged through the discharge port 103 to be directed toward the container, contaminated air generated from the container may be moved to the suction port 102 of the intake duct 110.

The processor 182 may adjust the rotation speed of the at least one blower 130, i.e., 130*a*-2 and 130*b*-2 based on at least one of the position of the container, the size of the container or a position of the burner selected by the user input. When the container and/or the selected burner is located at a relatively long distance from the discharge port 103, the processor 182 may increase the rotation speed of the blower 130. By increasing the flow rate and movement speed of air discharged through the discharge port 103, contaminated air generated from a container located relatively far away from the discharge port 103 may be effectively prevented from spreading.

In addition, the amount of contaminated air generated from a larger container may be greater than the amount of contaminated air generated from a smaller container. That is, as the size of the container increases, the flow rate and movement speed of air discharged through the discharge port 103 need to be increased to prevent contaminated air from spreading. The processor 182 may, in order to increase the flow rate and movement speed of air discharged from the discharge port 103 toward the large container, increase the rotation speed of the blower 130.

To correspond to the exhaust ducts 121 and 122 provided in plural, discharge blowers 130, i.e., 130*a*-2 and 130*b*-2 may also be provided in plural. For example, the discharge blowers 130 may include a third blower 130*a*-2 for flowing air into the first exhaust duct 121 and a fourth blower 130*b*-2 for flowing air into the second exhaust duct 122. The processor 182 may adjust the first rotation speed of the third blower 130*a*-2 and the second rotation speed of the fourth blower 130*b*-2 to be the same or different based on at least one of the position of the container, the size of the container or a position of the burner selected by the user input.

Some of the above-described components may be omitted from the cooking apparatus 1. In addition, the cooking apparatus 1 may further include other components in addition to the above-described components.

Figure 10:
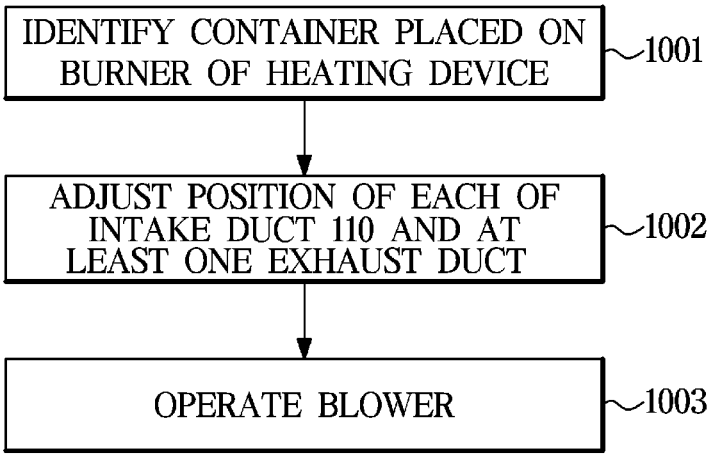
FIG. 10 is a flowchart showing an exemplary method of controlling a cooking apparatus according to various embodiments of the present disclosure.
Figure 11:
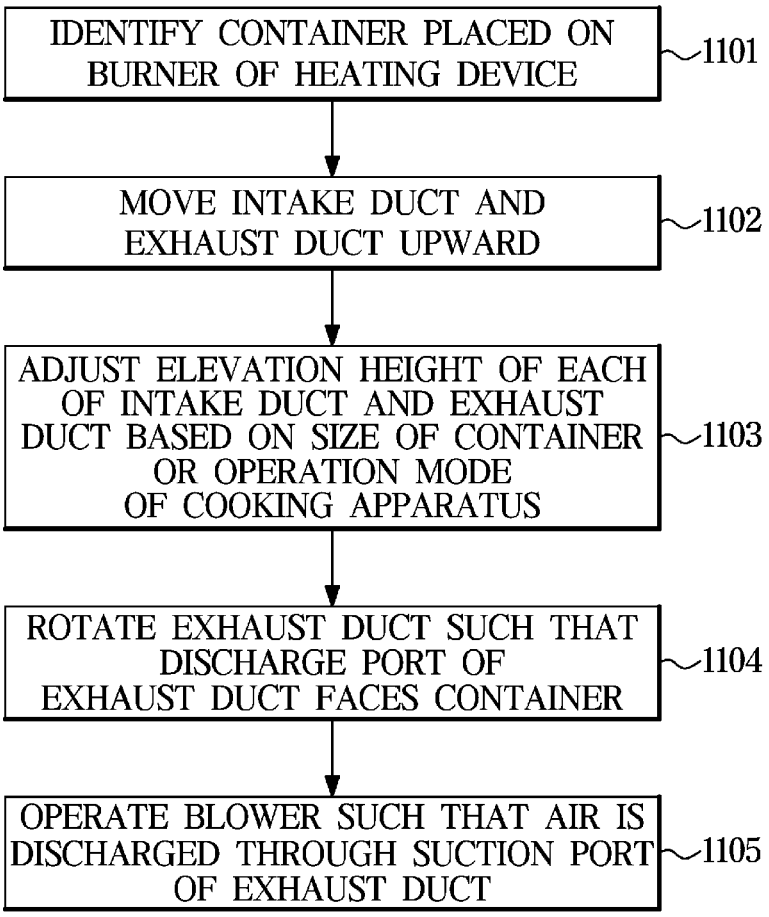
FIG. 11 is a flowchart for describing the control method shown in FIG. 10 in detail.

FIG. 10 is a flowchart showing a method of controlling a cooking apparatus according to an embodiment. FIG. 11 is a flowchart for describing the control method shown in FIG. 10 in detail.

Referring to FIGS. 10 and 11, the processor 182 of the cooking apparatus 1 may identify a container placed on a burner of the heating device 3 (1001 and 1101) and/or a selection of the burner by the user input. The processor 182 may identify the container based on a signal and/or data transmitted from the sensor 170 of the cooking apparatus 1. The processor 182 may identify a size of the container and a position of the container. The processor 182 may identify the selection of the burner based on the user input obtained through the control panel 160. In addition, the processor 182 may move the intake duct 110 and the at least one exhaust duct 120, i.e., 121 and 122 upward based on at least one of the identification of the container or the selection of the burner (1102). As the intake duct 110 and the at least one exhaust duct 120, i.e., 121 and 122 are moved upward, the suction port 102 and the discharge port 103 may be exposed to the outside of the housing 104.

The processor 182 may adjust the position for each of the intake duct 110 located on the first side of the heating device 3 and the at least one exhaust duct 120, i.e., the first exhaust duct 121 and the second exhaust duct 122, located on the second side of the heating device 3 opposite the first side of the heating device 3 based on at least one of the identification of the containe or the selection of the burner by the user input (1002). The adjusting of the position for each of the intake duct 110 and the exhaust duct 120 may include adjusting the elevation height and/or adjusting the rotation direction.

The processor 182 may adjust the elevation height for each of the intake duct 110 and the at least one exhaust duct 120 based on the size of the container or the operation mode of the cooking apparatus 1 (1103). The processor 182 may adjust the elevation height for each of the intake duct 110 and the at least one exhaust duct 120 such that the suction port 102 of the intake duct 110 and the discharge port 103 of the exhaust duct 120 are located at positions higher than the position of the container. When the exhaust duct 120 is provided in a plurality of units thereof, the elevation height for each of the plurality of exhaust ducts 121 and 122 may be individually adjusted.

In addition, the processor 182 may rotate the at least one exhaust duct 120, i.e., the first exhaust duct 121 and the second exhaust duct 122, such that the discharge ports 103, i.e., 103*a* and 103*b* of the exhaust ducts 120, i.e., the first exhaust duct 121 and the second exhaust duct 122 face the container and/or the burner selected by the user input (1104). The directions of the exhaust ducts 121 and 122 may be adjusted based on the position of the container and/or the position of the burner selected by the user input. When the exhaust duct 120 is provided in a plurality of units thereof, the rotation angle for each of the plurality of exhaust ducts 121 and 122 may be individually adjusted.

The processor 182 may operate at least one blower 130 and 230 positioned between the intake duct 110 and the exhaust duct 120 inside the housing 104 (1003 and 1105). At least one of a discharge blower 130 positioned in a lower portion of the exhaust duct 120 and a suction blower 230 positioned in a lower portion of the intake duct 110 may be provided inside the housing 104. As the blowers 130 and 230 operate, air may be discharged through the discharge port 103 of the exhaust duct 120, and the discharged air may be suctioned into the housing 104 through the suction port 102 of the intake duct 110. The suctioned air may be purified while passing through the air purification device 200 and may be discharged back to the discharge port 103 of the exhaust duct 120. In addition, when a plurality of discharge blowers 130*a*-2 and 130*b*-2 corresponding to the plurality of exhaust ducts 121 and 122 are provided, the rotation speed for each of the plurality of discharge blowers 130*a*-2 and 130*b*-2 may be individually adjusted.

Figure 12:
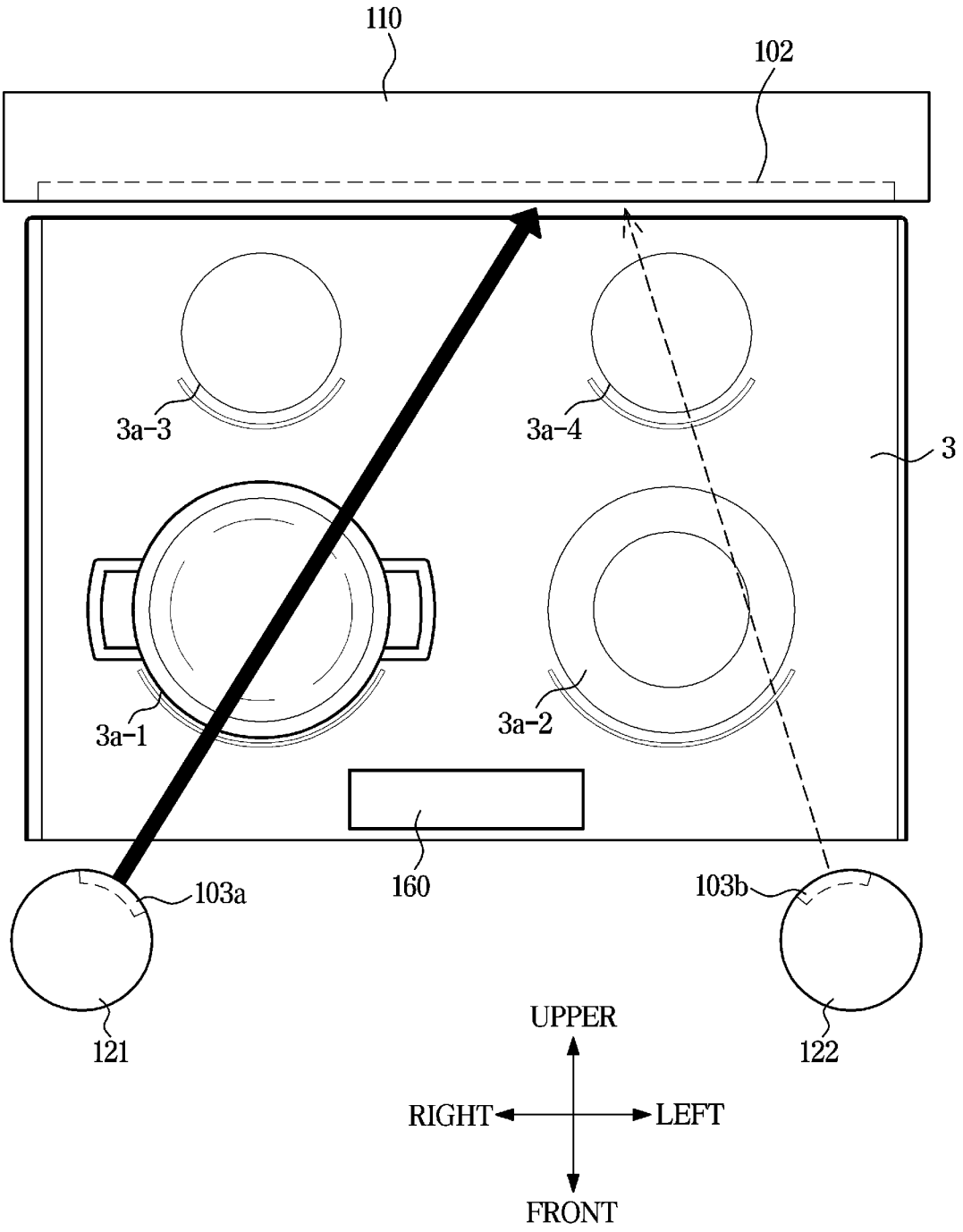
FIG. 12 is a plan view of the cooking apparatus shown in FIG. 8, which is viewed from the above.

FIG. 12 is a plan view of the cooking apparatus shown in FIG. 8, which is viewed from the above.

Referring to FIG. 12, a pot having a large height may be placed on the first heater 3*a*-1, and a frying pan having a small height may be placed on the second heater 3*a*-2. The positions of the intake duct 110, the first exhaust duct 121, and the second exhaust duct 122 may be adjusted based on the sizes and positions of the pot and the frying pan. In addition, the fourth heater 3*a*-4 may be selected as a control target by the user input.

Because the size of the pot is larger than that of the frying pan, the elevation height of the intake duct 110 may be adjusted based on the height of the pot placed on the first heater 3*a*-1. The elevation height of the first exhaust duct 121 may be adjusted based on the height of the pot placed on the first heater 3*a*-1, and the elevation height of the second exhaust duct 122 may be adjusted based on the height of the frying pan placed on the second heater 3*a*-2.

In addition, as the first exhaust duct 121 and the second exhaust duct 122 rotate, the first direction of the first discharge port 103*a* and the second direction of the second discharge port 103*b* may be adjusted, and the air discharge direction may be adjusted. For example, the processor 182 may rotate the first exhaust duct 121 for the first discharge port 103*a* to face the first heater 3*a*-1, and may rotate the second exhaust duct 122 for the second discharge port 103*b* to face the second heater 3*a*-2. The second direction of the second discharge port 103*b* may be determined in consideration of the position of the fourth heater 3*a*-4 selected as the control target by the user input.

In order that air is discharged toward a heater (e.g., the first heater 3*a*-1) selected through the control panel 160 among the plurality of heaters 3*a*, at least one of the rotation of the first exhaust duct 121 and the rotation of the second exhaust duct 122 may be adjusted. For example, when a larger amount of contaminated air is generated from the first heater 3*a*-1, at least one of the rotation angle of the first exhaust duct 121 and the second exhaust duct 122 may be adjusted such that the first discharge port 103*a* and the second discharge port 103*b* faces the first heater 3*a*-1.

In addition, in order that the first discharge port 103*a* adjacent to the first heater 3*a*-1 discharges air at a flow rate greater than that of air discharged through the second discharge port 103*b*, the rotation speed of the blower 130, i.e., the third blower 130*a*-2 and the fourth blower 130*b*-2 may be adjusted. Accordingly, ventilation of the ventilation device 100-2 may be performed more efficiently.

As described above, by appropriately adjusting the positions of the intake duct 110 and the exhaust duct 120 provided around the heating device 3, contaminated air generated during the cooking process may be blocked from spreading.

Figure 13:
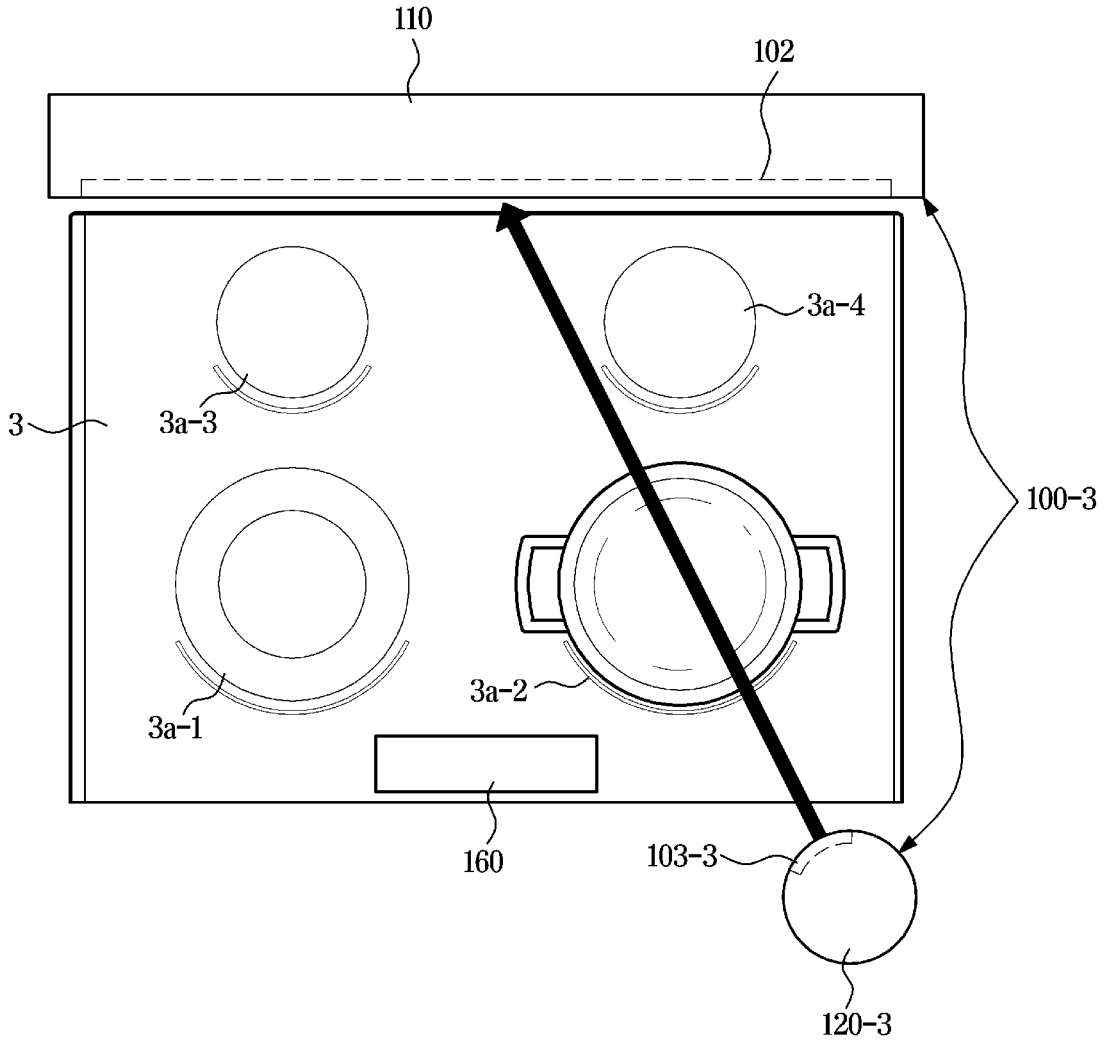
FIG. 13 is a plan view from above an example cooking apparatus including a ventilation device according to the various embodiments of the present disclosure.

FIG. 13 is a plan view from above an example cooking apparatus including a ventilation device according to various embodiments of the present disclosure, which is viewed from the above. The construction of the ventilation device 100 described in FIGS. 5 and 6 and the construction of the ventilation device 100-2 described in FIG. 8 may also be applied to a ventilation device 100-3 as shown in FIG. 13.

Referring to FIG. 13, a pan having a small size may be placed on the first heater 3*a*-1, and a pot having a large size may be placed on the second heater 3*a*-2. The size and heating power of the second heater 3*a*-2 may be greater than the size and heating power of the first heater 3*a*-1.

An exhaust duct 120-3 of the ventilation device 100-3 may be provided to be movable in the upward and downward directions. The exhaust duct 120-3 may be provided to be rotatable in the left and right directions about a rotation axis extending in the upper-lower direction.

The exhaust duct 120-3 may be provided in a single unit, and when viewed from the above of the heating device 3, the exhaust duct 120-3 may be disposed to be biased toward one side (e.g., the right side) with respect to a center in the left-right direction of the heating device 3. A discharge port 103-3 of the exhaust duct 120-3 may be directed to face a part (e.g., the second heater 3*a*-2) of the plurality of heaters 3*a*-1, 3*a*-2, 3*a*-3, and 3*a*-4). Air discharged from the discharge port 103-3 may cause contaminated air generated from the second heater 3*a*-2 to be moved toward the suction port 102. The heater 3*a* corresponding to the discharge port 103-3 of the exhaust duct 120-3 may be set in advance, or may be determined by a selection of a user.

Air discharged from the discharge port 103-3 of the exhaust duct 120-3 may form an air curtain. That is, the air discharged from the discharge port 103-3 may prevent oil mist generated from a container placed on the heater 3*a* from spreading. The air discharged from the discharge port 103-3 may cover at least one of the plurality of heaters 3*a*-1, 3*a*-2, 3*a*-3, and 3*a*-4. When the exhaust duct 120-3 is provided in a single unit, the volume of the ventilation device 100-3 may be reduced, and power consumption may be reduced.

Figure 14:
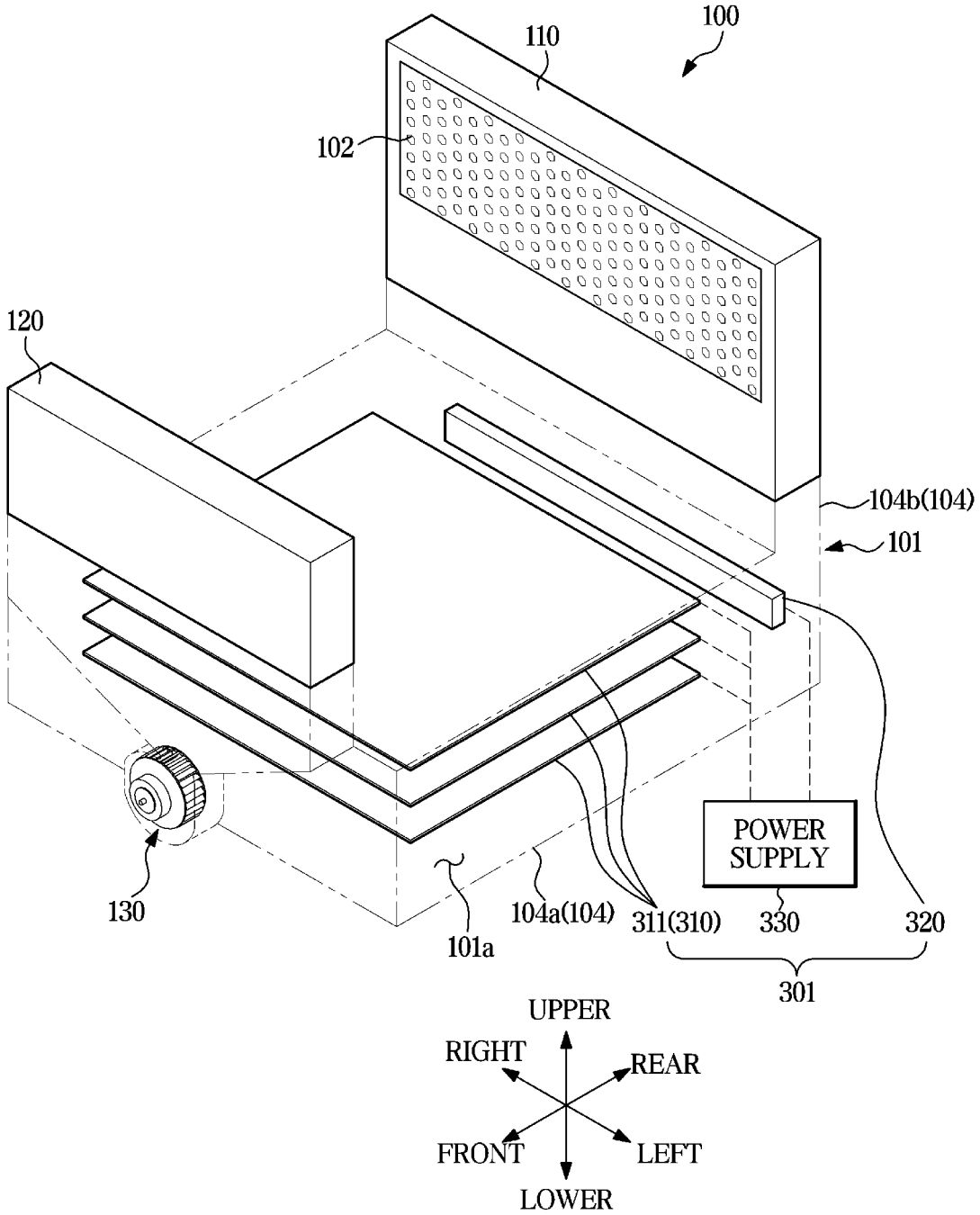
FIG. 14 illustrates an oil mist collection device according to various embodiments of the present disclosure.
Figure 15:
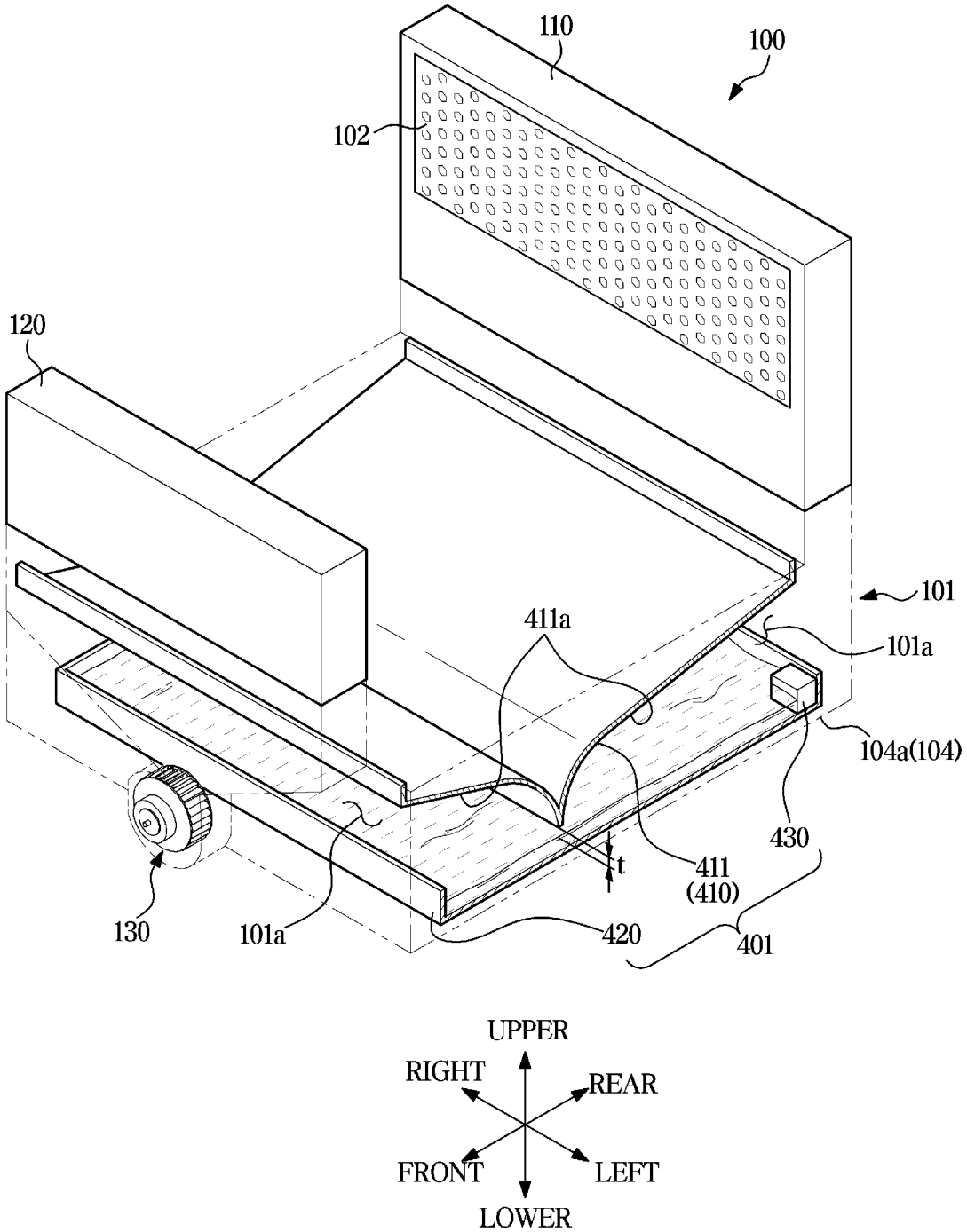
FIG. 15 illustrates an oil mist collection device according to various embodiments of the present disclosure.
Figure 16:
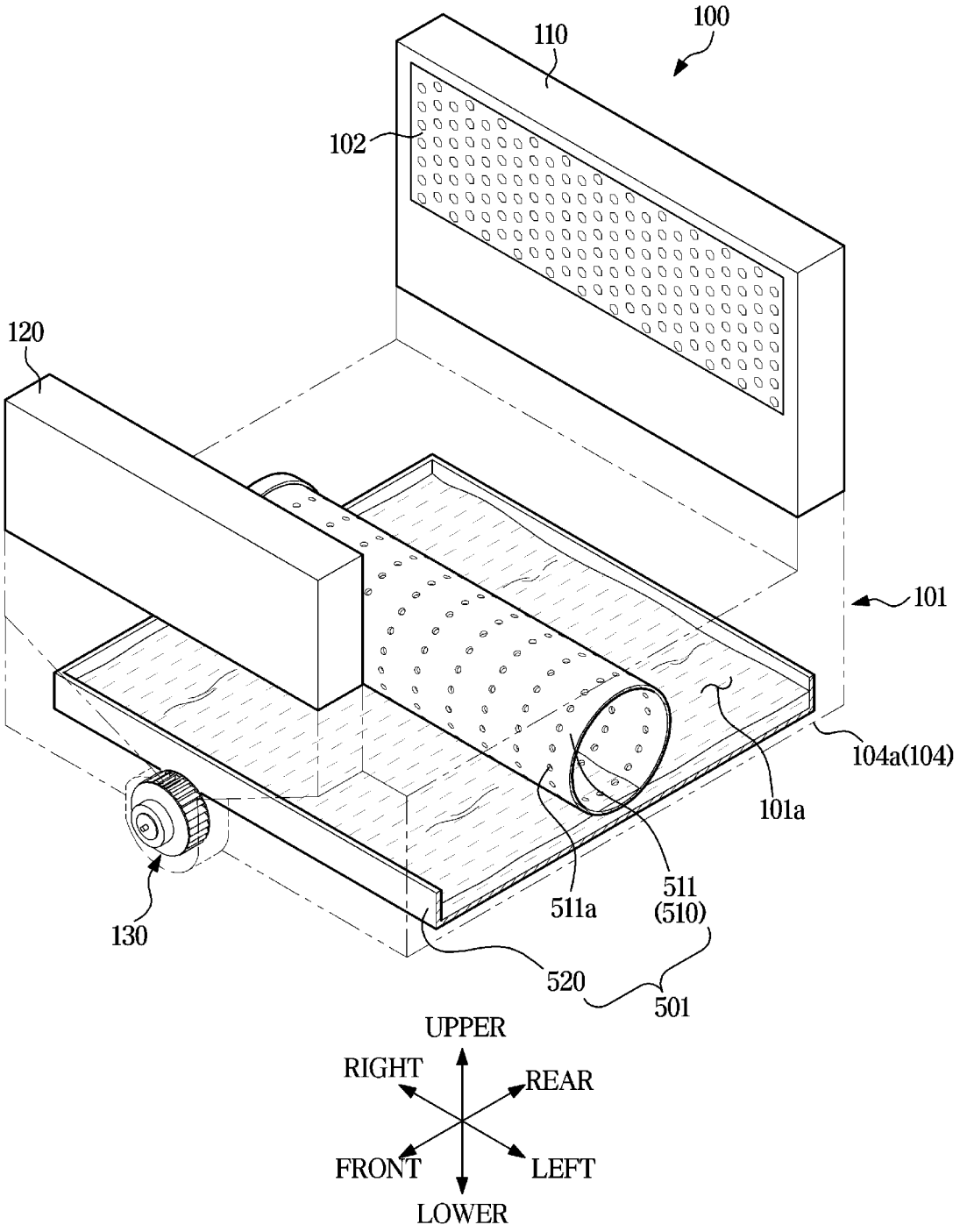
FIG. 16 illustrates an oil mist collection device according to various embodiments of the present disclosure.

FIGS. 14, 15, and 16 illustrate oil mist collection device according to various embodiments. In FIGS. 14, 15 and 16, oil mist collection devices 301, 401, and 501 according to various embodiments are illustrated as provided in the ventilation device 100, but the oil mist collection devices 301, 401, and 501 may be provided in the ventilation device 100', 100-1, 100-2, and 100-3 according to other embodiments described above.

FIG. 14 illustrates the oil mist collection device 301 according to various embodiments of the present disclosure.

Referring to FIG. 14, the oil mist collection device 301 may include a collecting member 310 allowing oil mist separated from air to adhere thereto and an ionizer 320 provided to charge oil mist of contaminated air.

The collecting member 310 may be in contact with air flowing through the inside of the ventilation device body 101. The collecting member 310 may be disposed on the flow path 101*a*. The collecting member 310 may be formed of a conductive material (e.g., aluminum, copper, stainless steel, etc.). The collecting member 310 may be formed of a metal material.

The collecting member 310 may include a plate 311. The plate 311 may have a substantially quadrangular flat plate shape. The plate 311 may be disposed in parallel with the direction of the airflow flowing through the flow path 101*a*. Specifically, the plate 311 may be disposed inside the housing 104 (e.g., inside the purification device receiver 104*a*), and may be disposed vertically or horizontally to be parallel with the direction of the airflow inside the housing 104 (e.g., inside the purification device receiver 104*a*). However, the disclosure is not limited thereto, and the collecting member 310 may include a conventional heat sink including a plurality of fins, a refrigerant tube, and the like.

The ionizer 320 may be provided to be in contact with the air flowing through the inside of the ventilation device body 101. The ionizer 320 may be disposed on the flow path 101*a*. The ionizer 320 may be disposed upstream of the flow path 101*a* than the collecting member 310 (e.g., the plate 311). The ionizer 320 may be disposed inside the purification device receiver 104*a*. However, the disclosure is not limited thereto, and the ionizer 320 may be disposed inside the intake duct receiver 104*b* and/or inside the intake duct 110.

The ventilation device 100 may include a power supply 330 (or "power") provided outside or inside the ventilation device body 101 and serving to supply power to the ionizer 320 and/or charge the plate 311. The power supply 330 may be electrically connected to the ionizer 320 and/or the plate 311.

The ionizer 320 may charge oil mist in the air flowing into the flow path 101*a* through the suction port 102. The charged oil mist may be caused to flow toward the charged collecting member 310 (e.g., the plate 311), and the charged oil mist may adhere to the surface of the collecting member 310 by electrostatic attraction. The collecting member 310 may obtain heat from the oil mist, which adheres to the collecting member 310, to condense the oil mist. That is, the condensed oil mist may adhere to the surface of the collecting member 310 (e.g., the plate 311). Because the oil mist on the surface of the collecting member 310 is condensed into oil droplets, even when the collecting member 310 (e.g., the plate 311) is not charged due to failure of electricity supply to the collecting member 310, the oil mist may not return to the air and may be removed from the air.

FIG. 15 illustrates the oil mist collection device 401 according to various embodiments of the present disclosure.

Referring to FIG. 15, the oil mist collection device 401 may include a collecting member 410 allowing oil mist separated from air to adhere thereto, a water tank 420 disposed below the collecting member 410 and accommodating water, and a water vapor generating device 430 for evaporating water in the water tank 420.

The collecting member 410 may be provided to be in contact with the air flowing through the inside of the ventilation device body 101. The collecting member 410 may be disposed on the flow path 101*a*.

The collecting member 410 may be formed of a thermally conductive material. The collecting member 410 may be formed of a metal material (e.g., aluminum, copper, stainless steel, etc.). However, the disclosure is not limited thereto, and the collecting member 410 may be formed of a material, such as plastic or glass.

The collecting member 410 may include a plate 411. The plate 411 may have a substantially quadrangular flat plate shape. The plate 411 may be disposed in parallel with the direction of the airflow flowing through the flow path 101*a*. Specifically, the plate 411 may be disposed inside the housing 104 (e.g., the purification device receiver 104*a*), and may be disposed vertically or horizontally to be parallel with the direction of the airflow inside the housing 104 (e.g., inside the purification device receiver 104*a*).

The water tank 420 may be disposed below the collecting member 410. The water tank 420 may be detachably disposed inside the housing 104 (e.g., inside the purification device receiver 104*a*). The water tank 420 may contain water.

The water vapor generating device 430 may be disposed inside the housing 104 (e.g., inside the purification device receiver 104*a*). The water vapor generating device 430 may be operated by receiving power from a power source (or "power supply") provided outside the ventilation device body 101. The water vapor generating device 430 may receive water from the water tank 420. At least a portion of the water vapor generating device 430 may be submerged in the water of the water tank 420. The water vapor generating device 430 may vaporize water using heat or ultrasonic waves. However, the disclosure is not limited thereto, and the water vapor generating device 430 may be variously provided as long as it can generate water vapor based on various mechanisms.

The water vapor generated by the water vapor generating device 430 may be mixed with oil mist and condensed on the surface of the collecting member 410 (e.g., the plate 411), and the oil mist may be removed from the contaminated air. In addition, the oil mist may come in direct contact with the water of the water tank 420 to thereby be condensed and removed from the contaminated air.

The collecting member 410 (e.g., the plate 411) may include a guide curved surface 411*a* that guides water droplets, which adhere to the surface of the collecting member 410 and contain condensed oil, to the water tank 420. The guide curved surface 411*a* may include a plurality of guide curved surfaces 411*a*. Specifically, the guide curved surface 411*a* may form a lower surface of the collecting member 410, and may approach the water tank 420 as extending from the rear end of the collecting member 410 toward the front side or as extending from the front end of the collecting member 410 toward the rear side.

An end of the guide curved surface 411*a* closest to the water tank 420 may be spaced apart from the surface of the water contained in the water tank 420 by a predetermined distance t. Air in the flow path 101*a* may flow through a gap t between the one end of the guide curved surface 411*a* and the surface of the water.

FIG. 16 illustrates the oil mist collection device 501 according to various embodiments of the present disclosure.

Referring to FIG. 16, the oil mist collection device 501 may include a collecting member 510 allowing oil mist separated from air to adhere thereto and a water tank 520 disposed below the collecting member 510 and receiving water.

The collecting member 510 may be provided to be in contact with the air flowing through the inside of the ventilation device body 101. The collecting member 510 may be disposed on the flow path 101*a*.

The collecting member 510 may be formed of a thermally conductive material. The collecting member 510 may be formed of a metal material (e.g., aluminum, copper, stainless steel, etc.). However, the disclosure is not limited thereto, and the collecting member 510 may be formed of a material, such as plastic or glass.

The collecting member 510 may include a plurality of holes 511*a* formed through a surface thereof. The plurality of holes 511*a* may be formed to have a predetermined depth from the surface of the collecting member 510 or may be formed to pass through the collecting member 510.

The collecting member 510 may include a cylinder 511 having the plurality of holes 511*a* formed on a surface thereof. The cylinder 511 may be rotatable about a central axis. The oil mist collection device 501 may include a rotating device (not shown) provided to rotate the cylinder 511 by receiving power from a power source (or "power supply") provided outside the ventilation device body 101 and including a motor. The cylinder 511 may be rotated by the rotating device. The cylinder 511 may be disposed inside the housing 104 (e.g., inside the purification device receiver 104*a*), and the central axis of the cylinder 511 may be perpendicular to the direction of an airflow inside the housing 104 (e.g., the purification device receiver 104*a*).

The water tank 520 may be disposed below the collecting member 510. The water tank 520 may be detachably disposed inside the housing 104 (e.g., inside the purification device receiver 104*a*), and the water tank 520 may contain water.

At least a portion of the collecting member 510 (e.g., the cylinder 511) may be submerged in the water of the water tank 520. The cylinder 511 may be rotated with a portion thereof submerged in water. Water of the water tank 520 may permeate into the plurality of holes 511*a* submerged in water of the water tank 520, and as the cylinder 511 rotates, the plurality of holes 511*a* may transport the water of the water tank 520 upward of the water level such that the water may be exposed to the flow path 101*a*. In addition, the collecting member 510 (e.g., the cylinder 511) may be cooled by the water of the water tank 520.

The collecting member 510 (e.g., the cylinder 511) may cause the water permeating in the hole 511*a* to come in contact with oil mist, and the oil mist in contact with the water permeating in the hole 511*a* may be condensed and removed from the contaminated air. In addition, oil mist may come in direct contact with the water of the water tank 520 to be condensed and removed from the contaminated air. In addition, on the surface of the collecting member 510 (e.g., the cylinder 511) kept cold by the water of the water tank 520, oil mist may be condensed and removed from the contaminated air.

As described above, the cooking apparatus and the method of controlling the same according to the embodiment may effectively prevent contaminated air generated during the cooking process from spreading.

The cooking apparatus and the method of controlling the same according to the embodiment may block the spread of contaminated air generated during the cooking process by appropriately adjusting the positions of the intake duct and the exhaust duct provided around the heating device.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments.

Machine-readable storage medium may be provided in the form of a non-transitory storage medium. Here, when a storage medium is referred to as "non-transitory," it may be understood that the storage medium is tangible and does not include a signal (e.g., electromagnetic waves), and the term does not distinguish between data stored semi-permanently in a storage medium and data stored temporarily in a storage medium. For example, the 'non-transitory storage medium' may include a buffer in which data is temporarily stored.

According to one embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed through an application store (e.g., Play Store™) online. In the case of online distribution, at least a portion of the computer program product may be stored at least semi-permanently or may be temporarily generated in a storage medium, such as a memory of a server of a manufacturer, a server of an application store, or a relay server.

As is apparent from the above, the cooking apparatus and the method of controlling the same according to the embodiment can effectively prevent contaminated air generated during a cooking process from spreading.

The cooking apparatus and the method of controlling the same according to the embodiment can block the spread of contaminated air generated during a cooking process by appropriately adjusting the positions of an intake duct and an exhaust duct provided around a heating device.

The disclosed embodiments have been described above with reference to the accompanying drawings. It will be understood by those of ordinary skill in the art to which the disclosed embodiments belong that the disclosed embodiments may be implemented in different forms from the disclosed embodiments without departing from the spirit and scope of the disclosed embodiments. The disclosed embodiments are and should not be interpreted as restrictive.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a heating device including a plurality of burners;

an intake duct provided at a rear of the heating device and configured to move upward or downward, and including a suction port configured to suck air;

at least one exhaust duct provided at a front of the heating device opposite the intake duct and configured to move upward or downward, and including a discharge port configured to discharge the air;

a control panel configured to obtaining a user input;

at least one blower configured to flow the air such that the air sucked through the intake duct is discharged through the at least one exhaust duct; and a processor operably coupled to the control panel, wherein the processor is configured to:

identify a container placed on at least one burner, adjust a position for each of the intake duct and the at least one exhaust duct based on a size of the container, adjust a rotation speed of the at least one blower based on the size of the container, and increase the rotation speed of the at least one blower to increase a flow rate and movement speed of air discharged from the discharge port based on the size of the container and the at least one blower is located between the discharge port and an oil mist collection device.

2. The cooking apparatus of claim 1, wherein the processor is further configured to adjust an elevation height for each of the intake duct and the at least one exhaust duct based on the size of the container.

3. The cooking apparatus of claim 2, wherein the elevation height for each of the intake duct and the at least one exhaust duct is adjusted such that the suction port and the discharge port are located at positions higher than a position of the container.

4. The cooking apparatus of claim 1, wherein the processor is further configured to adjust an elevation height for each of the intake duct and the at least one exhaust duct based on an operation mode selected through the control panel.

5. The cooking apparatus of claim 1, further comprising:

a first elevation device configured to raise or lower the intake duct; and a second elevation device configured to raise or lower the at least one exhaust duct, wherein the first elevation device and the second elevation device include a rack, a pinion, and a motor, respectively, and wherein the processor is further configured to control the first elevation device and the second elevation device.

6. A method of controlling a cooking apparatus including a heating device, the method comprising:

identifying a container placed on at least one burner of the heating device;

adjusting, based on a size of the container, a position for each of an intake duct located at a rear of the heating device and at least one exhaust duct located at a front of the heating device;

operating at least one blower provided to discharge air sucked through the intake duct through the at least one exhaust duct; and adjusting a rotation speed of the at least one blower based on the size of the container, wherein the adjusting the rotation speed of the at least one blower includes increasing the rotation speed of the at least one blower to increase a flow rate and movement speed of air discharged from a discharge port based on the size of the container and the at least one blower is located between the discharge port and an oil mist collection device.

7. The method of claim 6, wherein adjusting the position comprises adjusting an elevation height for each of the intake duct and the at least one exhaust duct based on an operation mode of the cooking apparatus.

8. The method of claim 6, wherein adjusting the position comprises adjusting an elevation height for each of the intake duct and the at least one exhaust duct based on the size of the container.

9. The method of claim 8, wherein adjusting the position comprises adjusting an elevation height for each of the intake duct and the at least one exhaust duct such that a suction port provided in the intake duct and a discharge port provided in the at least one exhaust duct are located at positions higher than a position of the container.

10. The cooking apparatus of claim 1, wherein the processor is further configured to adjust, based on a selection of a burner by the user input, a position for each of the intake duct and the at least one exhaust duct.

11. The method of claim 6, further comprising adjusting, based on a selection of a burner by a user input, a position for each of the intake duct and the at least one exhaust duct.

12. The cooking apparatus of claim 1, wherein the processor is further configured to adjust the rotation speed of the at least one blower based on a position of the container.

13. The method of claim 6, further comprising adjusting the rotation speed of the at least one blower based on a position of the container.

* * * * *